US008165851B2

(12) United States Patent
Antuma et al.

(10) Patent No.: US 8,165,851 B2
(45) Date of Patent: Apr. 24, 2012

(54) PROGRAM AND METHOD FOR LOCATING FASTENERS

(76) Inventors: George D. Antuma, Holland, MI (US); Scott E. Sluiter, Holland, MI (US)

( * ) Notice: Subject to any disclaimer, the term of this patent is extended or adjusted under 35 U.S.C. 154(b) by 1158 days.

(21) Appl. No.: 11/962,702

(22) Filed: Dec. 21, 2007
(Under 37 CFR 1.47)

(65) Prior Publication Data

US 2008/0177426 A1 Jul. 24, 2008

Related U.S. Application Data

(60) Provisional application No. 60/876,378, filed on Dec. 21, 2006.

(51) Int. Cl.
*G06F 17/50* (2006.01)

(52) U.S. Cl. ..... 703/1

(58) Field of Classification Search ..... 703/1
See application file for complete search history.

(56) References Cited

U.S. PATENT DOCUMENTS

| | | | | |
|---|---|---|---|---|
| 5,947,460 | A * | 9/1999 | Williams | 269/37 |
| 7,433,796 | B2 * | 10/2008 | Behan et al. | 702/150 |
| 2006/0195303 | A1 * | 8/2006 | Thompson et al. | 703/1 |

* cited by examiner

*Primary Examiner* — Dwin M Craig
*Assistant Examiner* — Aniss Chad
(74) *Attorney, Agent, or Firm* — Price Heneveld LLP

(57) ABSTRACT

A method and system for determining fastener locations at the joints of chord and web members of a roof truss determines an allowable area within which fasteners can be placed at the joints. Fastener locations within the allowable areas are determined, and additional information is associated with each fastener location. The additional information may include a fastener installation parameter than can be compared to a parameter measured during installation of the fastener to determine if the fastener has been properly installed. The fastener locations within the allowable area may be arranged to form a non-linear zig-zag pattern.

24 Claims, 14 Drawing Sheets

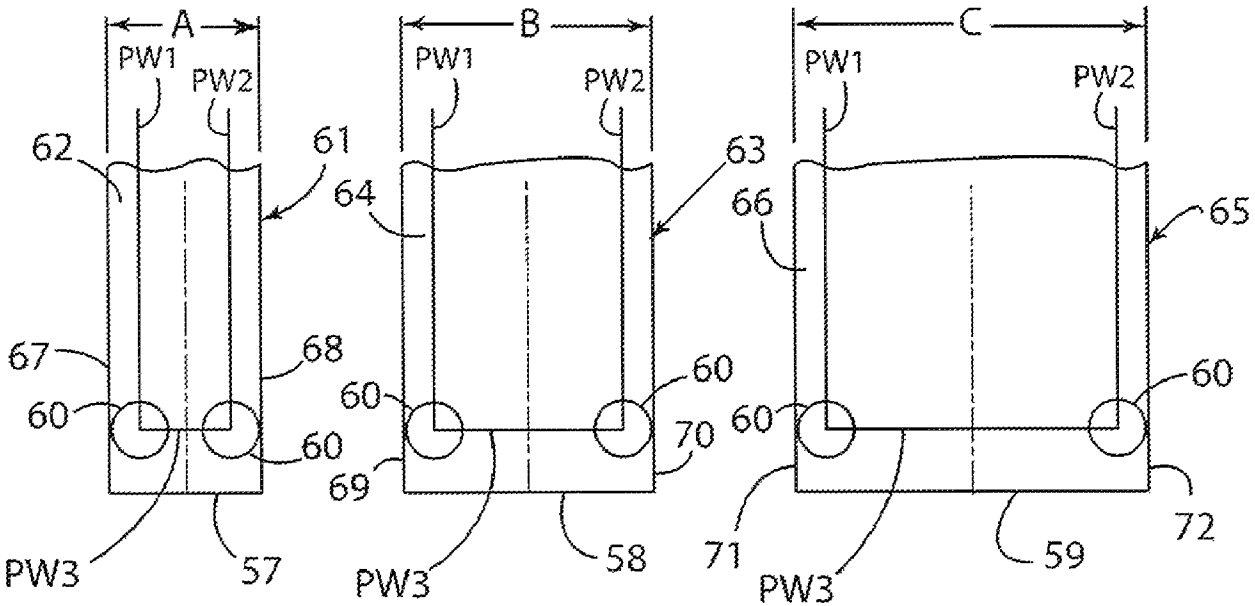
FIG. 4A
FIG. 4B
FIG. 4C
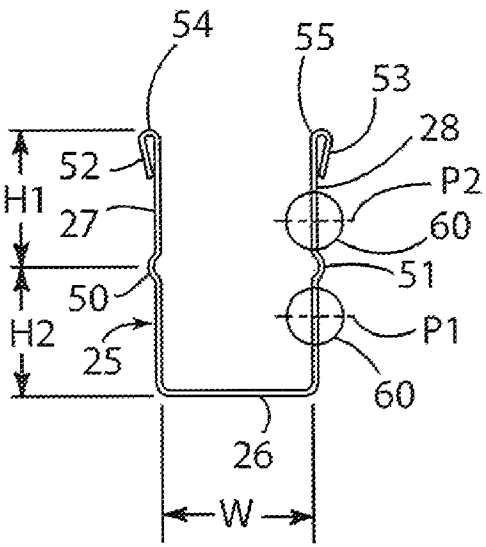
FIG. 4

| 151 | 152 X | 153 Y | 154 | 155 | 156 | 157 |
|---|---|---|---|---|---|---|
| F | 0.75 | 10.3529 | 7 | 0 | 2 | 1 |
| F | 0.3102 | 11.2163 | 7 | 0 | 2 | 1 |
| F | 0.3469 | 9.9499 | 7 | 0 | 2 | 1 |
| F | 1.1531 | 10.756 | 7 | 0 | 2 | 1 |
| F | 0.465 | 1.695 | 7 | 0 | 1 | 2 |
| F | 0.465 | 0.7735 | 7 | 0 | 1 | 2 |
| F | 1.035 | 0.7735 | 7 | 0 | 1 | 2 |
| F | 1.035 | 1.695 | 7 | 0 | 1 | 2 |
| R | 12 | | | | | |
| F | 16.965 | 26.7817 | 15 | 0 | 4 | 1 |
| F | 15.3612 | 24.9641 | 5 | 0 | 4 | 1 |
| F | 15.8121 | 25.415 | 5 | 0 | 4 | 1 |
| F | 16.965 | 27.7032 | 15 | 0 | 4 | 1 |
| . | . | . | . | . | . | . |
| . | . | . | . | . | . | . |
| . | . | . | . | | | |
| F | 117.1054 | 1.695 | 7 | 0 | 11 | 2 |
| I | 120 | | | | | |
| F | 158.9245 | 26.7817 | 7 | 0 | 12 | 1 |
| F | 158.3545 | 26.7817 | 7 | 0 | 12 | 1 |
| F | 159.4945 | 26.7817 | 7 | 0 | 12 | 1 |
| F | 160.0645 | 26.7817 | 7 | 0 | 12 | 1 |
| F | 161.715 | 26.7817 | 7 | 0 | 14 | 1 |
| F | 161.715 | 27.7032 | 7 | 0 | 14 | 1 |
| F | 162.285 | 26.7817 | 7 | 0 | 14 | 1 |
| S | 162.285 | 27.7032 | 7 | 0 | 14 | 1 |
| S | 209.465 | 26.7817 | 15 | 0 | 15 | 1 |
| S | 207.4446 | 26.7817 | 5 | 0 | 15 | 1 |
| F | 208.2086 | 26.7817 | 5 | 0 | 15 | 1 |
| F | 209.465 | 27.7032 | 15 | 0 | 15 | 1 |
| F | 209.75 | 23.681 | 5 | 0 | 15 | 1 |
| F | 209.75 | 24.304 | 5 | 0 | 15 | 1 |
| F | 210.035 | 26.7817 | 15 | 0 | 15 | 1 |
| F | 210.035 | 27.7032 | 15 | 0 | 15 | 1 |
| F | 211.1756 | 25.3807 | 5 | 0 | 15 | 1 |
| F | 211.6681 | 24.8883 | 5 | 0 | 15 | 1 |
| F | 161.715 | 1.695 | 7 | 0 | 13 | 2 |
| F | 161.715 | 0.7735 | 7 | 0 | 13 | 2 |
| F | 162.285 | 0.7735 | 7 | 0 | 13 | 2 |
| F | 162.285 | 1.695 | 7 | 0 | 13 | 2 |
| F | 209.465 | 1.695 | 7 | 0 | 16 | 2 |
| F | 209.465 | 0.7735 | 7 | 0 | 16 | 2 |
| F | 210.035 | 0.7735 | 7 | 0 | 16 | 2 |
| F | 210.035 | 1.695 | 7 | 0 | 16 | 2 |
| R | 214.9534 | . | . | . | . | . |

158

FIG. 14

PROGRAM AND METHOD FOR LOCATING FASTENERS

CROSS-REFERENCE TO RELATED APPLICATIONS

This application claims the benefit of U.S. Provisional Application No. 60/876,378, filed on Dec. 21, 2006, entitled TRUSS ASSEMBLY PROGRAM AND METHOD, the entire contents of which are incorporated by reference.

BACKGROUND OF THE INVENTION

Roof structures for buildings commonly include trusses that provide structural support for the roof deck. Such trusses typically include elongated top and bottom chords, and a plurality of elongated web members extending between and interconnecting the chords to form a rigid structure. A given building design may include a large number of trusses of various sizes and shapes as required to provide the desired roof size and shape for the building design as specified by the architect. Because the roof truss designs vary significantly, large-scale production of standardized roof trusses meeting all of the requirements for each unique building design is often not feasible.

One type of building truss includes a top chord made of an elongated steel member having a downwardly-opening U-shaped cross section, and a bottom chord having an upwardly-opening U-shaped elongated member. A plurality of tubular web members having a square cross-sectional shape extend in between and interconnect the top and bottom chords. The ends of the tubular web members are received between the side walls of the U-shaped top and bottom chords, and sheet metal screws or the like are driven through the side walls of the top and bottom chords and the side walls of the tubular web members to thereby interconnect the chords and webs at the joints. The loads on a particular joint may require that the joint be reinforced with a plate member. If the joint includes such a plate member, the threaded screws are generally driven through both the plate and the side walls of the chord and web.

Such trusses have been manually fabricated on a large work surface or the like. Typically, the chords and webs are manually positioned by a worker, and self-drilling and tapping sheet metal screws are driven into the joints by a worker utilizing a powered hand tool or the like. The manual labor required to assemble such roof trusses adds to the total cost of the roof truss.

Accordingly, a way to assemble roof trusses in a manner that alleviates the above-identified drawbacks of known assembly procedures would be beneficial.

SUMMARY OF THE INVENTION

One aspect of the present invention is a method for determining the position of fasteners of joints that interconnect linear structural members forming chords and webs of roof trusses. The method may be utilized to generate a set of data/instructions that can be used by an automatic screw-driving machine of the type disclosed in co-pending U.S. patent application Ser. No. 11/961,522, TRUSS ASSEMBLY APPARATUS AND METHOD, filed on Dec. 20, 2007, the entire contents of which are hereby incorporated by reference.

The method includes selecting a threaded fastener or the like having a predetermined size and configuration that is suitable for the truss that is being assembled. Truss information concerning a truss to be assembled is acquired from design and engineering software. The information may include information for the joints such as the minimum number of fasteners, the thickness of the material at the joint, and the number of layers of materials, as well as the geometry of the truss including the lengths and positions of the chords and webs. The chords and webs each include side walls and portions of the side walls of the chords and webs overlap at the joints. The truss joint information includes the minimum required number of fasteners for a joint, and the positions of the chords and the webs, including the angles and positions of the chords and webs at the joints. The method further includes defining first and second fastener priority placement lines extending parallel to one another along portions of the chord in the vicinity of the joint. The first and second fastener placement lines of the chord are located on portions of the side wall of the chord that meet predetermined engineering criteria with respect to placement of fasteners of the type selected to form the joint. First and second placement lines are defined along portions of the web in the vicinity of the joint. The first and second fastener placement lines extend parallel to one another, and are located on portions of the side wall of the web that meet predetermined engineering criteria with respect to placement of fasteners of the type selected to form the joint. The first and second fastener placement lines of the chord intersect the first and second fastener placement lines of the web to define a parallelogram having a first pair of opposite corners defining acute angles. The method includes defining a rectangle having opposite corners coincident with the first pair of opposite corners for the parallelogram, and first and second opposite sides coincident with the first and second fastener placement lines of a selected one of the chord and the web. The method further includes determining a tolerance circle based, at least in part, upon the maximum variation in location of a machine used to install the fasteners, and a size of the head of a fastener selected. A plurality of tolerance circles are positioned on the first and second fastener placement lines in a zigzag pattern. The centers of the tolerance circles define fastener positions that can be used to position fasteners for interconnecting the chord and the web at the joint.

In this way, the present invention provides a way to automatically maximize the number of fasteners that can be installed at a particular joint utilizing this algorithm. The method and software of the present invention also ensures that the minimum required number of fasteners are properly installed at a particular joint. For most joints, the present method will provide a number of possible screw locations, and also provide a ranking of the positions in terms of priority. This ranking can be used to provide a sequence for driving the fasteners at each of the locations. The screw-driving machine measures the torque and other variables or fastener parameters as the fastener is being driven to determine if the screw has been properly installed. The number and thickness of the layers of material that the threaded fastener is expected to be driven through can be used to determine expected fastener parameters for each individual fastener. If one or more of the measured variables for a screw being driven do not fall within an expected parameter range with respect to the expected fastener installation criteria, the controller of the screw-driving machine determines that the threaded fastener was not properly driven. In operation, the screw-driving machine will automatically install fasteners at the fastener locations in the predetermined sequence until the minimum number of fasteners required for a particular joint has been achieved. In the event a large number of fasteners, greater than the number of required fasteners, are not properly driven at a particular joint, such that all of the allowable screw locations are used up without meeting the minimum required number of "good" screws for a particular joint, the system generates a signal warning the machine operator or other individual that a particular joint has not been properly secured, such that additional manual re-work or other corrective action can be taken.

These and other features, advantages, and objects of the present invention will be further understood and appreciated by those skilled in the art by reference to the following specification, claims, and appended drawings.

BRIEF DESCRIPTION OF THE DRAWINGS

FIG. 4 is a partially schematic view showing various allowable screw locations for a first chord profile having a first cross-sectional shape;

FIG. 4A is a fragmentary view of an end portion of a web member having a first size/configuration;

FIG. 4B is a fragmentary view of an end portion of a web member having a second size/configuration;

FIG. 4C is a fragmentary view of an end portion of a web member having a third size/configuration;

FIG. 14 is a data file in .csv format generated by the method/program for use by a truss assembly machine;

DETAILED DESCRIPTION OF PREFERRED EMBODIMENT

Figure 1:
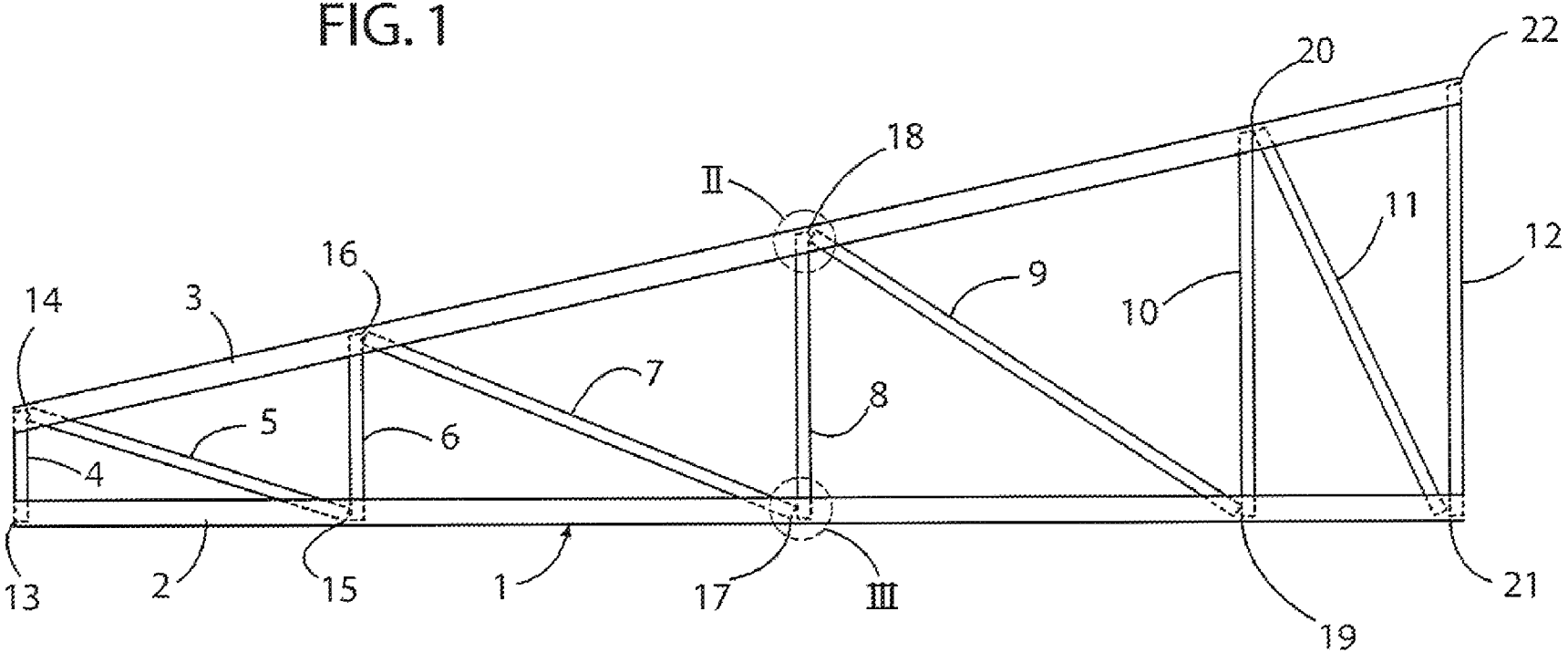
FIG. 1 is a partially schematic view of a roof truss assembly of the type that may be assembled according to the present invention.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The computer program and method of the present application generates a data file including fastener locations and related information for building trusses. The data file is utilized by the truss assembly machine/apparatus described in co-pending U.S. patent application Ser. No. 11/961,522, filed on Dec. 20, 2007, entitled TRUSS ASSEMBLY APPARATUS AND METHOD, to drive fasteners in the proper locations. The entire contents of this patent application are hereby incorporated by reference.

Figure 5B:
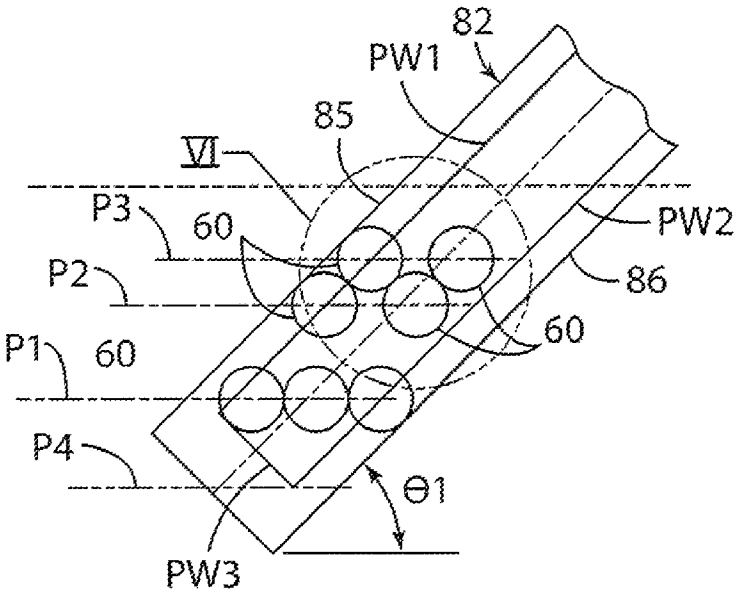
FIG. 5B is a fragmentary view of an end portion of a web member that is angled relative to the second chord profile.
Figure 5A:
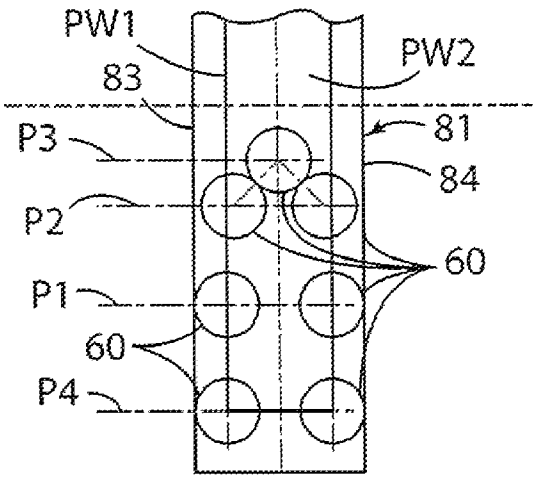
FIG. 5A is a fragmentary view of an end portion of a web member that may be connected to the second chord profile of FIG. 5.
Figure 5:
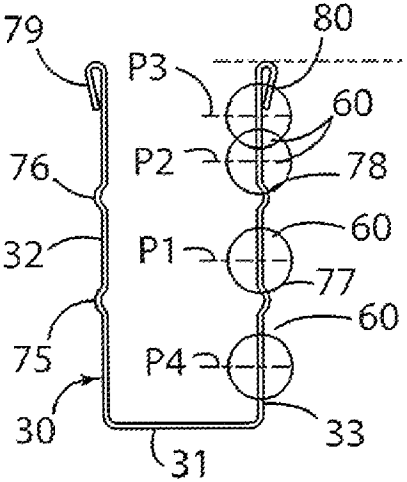
FIG. 5 is a partially schematic view showing various allowable screw locations for a second chord profile having a second cross-sectional shape.

With reference to FIG. 1, a roof truss 1 includes various components such as a first or lower chord 2 and a second or upper chord 3 that are interconnected by a plurality of webs 4-12. The opposite ends of the webs 4-12 are interconnected to the chords 2 and 3 at joints 13-22. In the illustrated example, the chords 2 and 3 have a U-shaped cross section. However, it will be understood that a range of cross-sectional shapes may be utilized for the chords 2 and 3. A first chord cross-sectional shape or profile 25 is shown in FIG. 4, and a second chord cross-sectional shape or profile 30 is shown in FIG. 5. Profile 25 includes a base wall 26, a pair of side walls 27 and 28 extending from the base wall 26, and the second chord cross sectional shape or profile 30 includes a base wall 31 and side walls 32 and 33.

Figure 3:
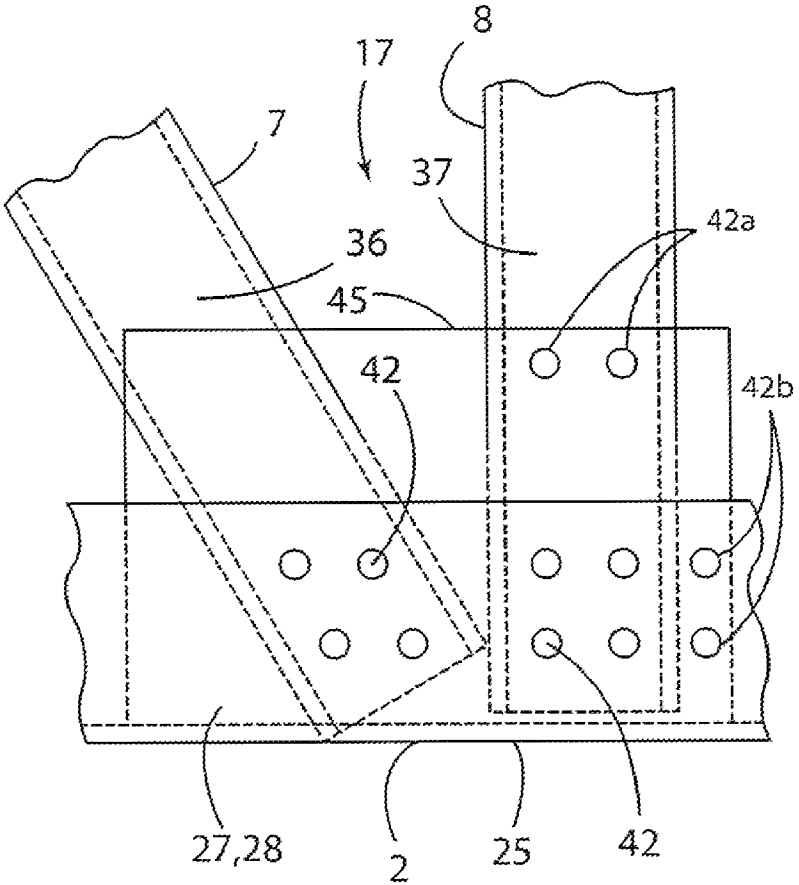
FIG. 3 is a partially fragmentary enlarged view of a joint of the truss of FIG. 1.
Figure 2:
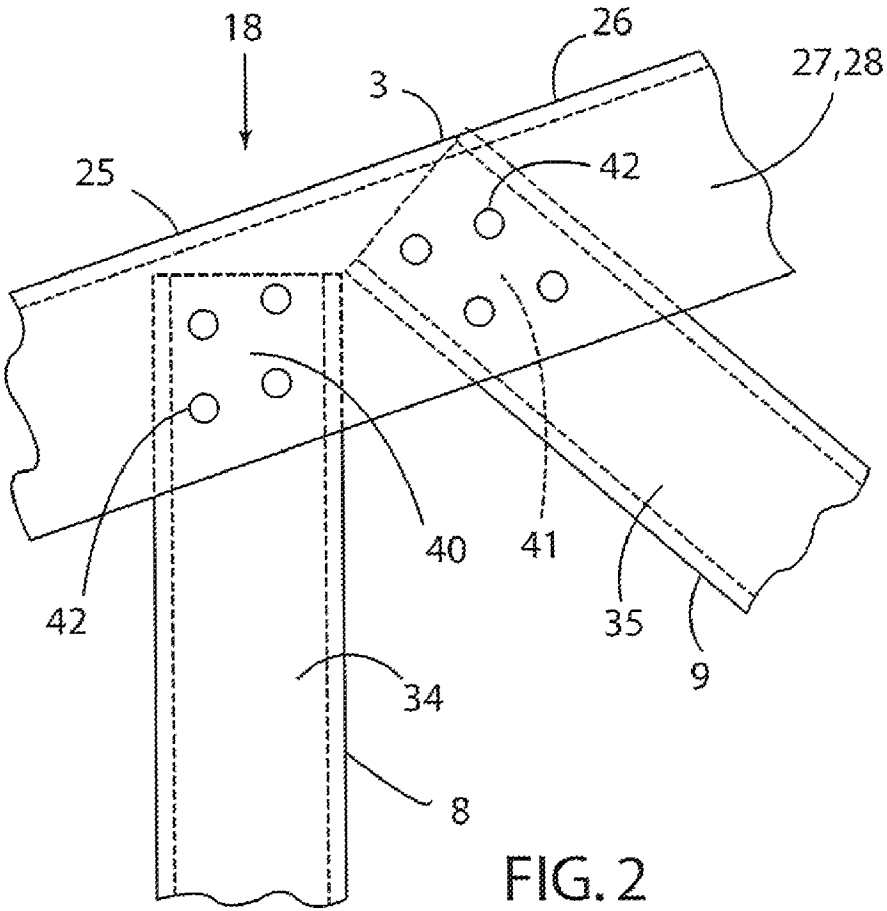
FIG. 2 is a partially fragmentary enlarged view of a joint of the truss of FIG. 1.

With further reference to FIG. 2, at joint 18, an end 40 of web 8 and an end 41 of web 4 are received between the side walls 27 and 28 of chord 3. In the illustrated example, chord 3 has a profile 25 as shown in FIG. 4. However, chord 3 could have a variety of cross-sectional shapes, depending upon the particular requirements of the roof truss 1 being assembled. A plurality of threaded fasteners 42 (FIG. 2) are driven through side walls 27 and 28 of chord 3, and through side walls 34 and 35 of webs 8 and 9, respectively to rigidly interconnect the chord 3 and the webs 8 and 9. The threaded fasteners 42 are preferably self-drilling and self-tapping sheet metal screws that can be automatically driven by a power screw driving head of a known design. With further reference to FIG. 3, a plurality of threaded fasteners 42 are driven through the side walls 27 and 28 of chord 2, and through the side walls 36 and 37 of webs 7 and 8 to rigidly interconnect the chord 3 and webs 7 and 8 at the joint 17. Joint 17 also includes a pair of plates 45 that are used to reinforce joint 17. As discussed in more detail below, the joints interconnecting the chords and webs may not include a plate if the joint is sufficiently strong without a plate. Also, the thickness of the plate may vary from joint to joint depending upon the loads and associated strength requirements for a specific joint. In the illustrated example, plate 45 is positioned between the chords 7 and 8 and the side walls 27 and 28 of chord 2. The threaded fasteners 42 are driven through the side walls 27 and 28 of chord 2 and the side walls 36 and 37 of the webs 7 and 8, and also through the pair of plates 45. Thus, each of the threaded fasteners 42 utilized in the joint 17 is driven through a total of three layers of material. If required to obtain the needed strength for a particular joint, additional fasteners 42A may be driven through plates 45 into side wall 37 of web 8, but not through side walls 27, 28 of chord 3. Additional threaded fasteners 42B may also be driven through side walls 27 and 28 of chord 2 and through plates 45, but not through side walls 36, 37 of webs 7 and 8. In the illustrated example, the chords, webs, and plates are all made of galvanized steel. However, these components could comprise painted or coated steel, aluminum, composite materials, or other materials. Also, although threaded fasteners 42 are shown, it is anticipated that the fasteners could comprise rivets, spot welds, or other connectors.

With reference to FIG. 4, chord profile or cross section 25 includes elongated raised ridges 51 and 52 in side walls 27 and 28, and rolled-over flanges 52 and 53 at ends 54 and 55 of side walls 27 and 28. The threaded fasteners are positioned such that they do not contact the raised ridges 51 and 52 or other obstructions/features that might be present on chord members having different chord profiles. The chord profile 25 has a first height dimension "H1" of 1 5/16 inches, a dimension "H2" of 1 1/4 inches, and an internal width "W" of 1 1/2 inches. Profiles 25 (FIG. 4) and 30 (FIG. 5) are standard, commercially available profiles previously utilized to fabricate roof trusses and the like. A variety of other profiles (not shown) may also be utilized if required for a particular roof truss.

In order to determine the permissible locations for the threaded fasteners 42 along a chord having a profile 25, priority lines P1 and P2 are first selected for a particular chord profile 25. Allowable placement of priority lines P1 and P2 may be illustrated utilizing fastener circles 60. In the illustrated example, the diameter of the fastener circles 60 is three times the diameter of the heads of the threaded portion of the threaded fasteners 42. (The circles 42 represent the heads of the threaded fasteners 42). The diameter of the fastener circles 60 represents the closest allowable spacing of the threaded fasteners 42 to a cut sheet metal edge according to the applicable engineering standards. In the illustrated example, the fasteners are also spaced apart a minimum distance of three times the diameter of the threaded portions of the fasteners 42. However, the fastener-to-fastener spacing may not be the same as the minimum distance between threaded fasteners 42. In the illustrated example, the applicable standard is the Cold Formed Steel Framing Standard that is promulgated by the American Iron and Steel Institute (A.I.S.I.). However, the diameter of fastener circles 60 may vary depending upon the standards that apply to a particular truss being built, and the size and type of fastener being used. The threaded fasteners 42 are nominally positioned at the center of the fastener circles 60, and the fastener circles 60 therefore represent "allowable" fastener locations (i.e., fastener locations that meet predefined criteria with respect to spacing of the fasteners relative to one another, edges of the material, etc.). The fastener circles 60 may be utilized to illustrate allowable fastener positions relative to other fasteners and/or edges of the components. However, the method and program of the present invention are not limited to the use of fastener circles 60, and it will be understood that the fastener circles 60 are simply utilized herein to illustrate the concepts of the present invention. The fastener locations determined by the program/method are the center points of the fastener circles 60.

The priority lines P1 and P2 are extend boundary lines extending the length of the chord, and the position of lines P1 and P2 are selected such that fastener circles 60 can be placed on and/or inside lines P1 and P2 and meet the applicable engineering code requirements with respect to spacing from a rolled or folded edge (1.5*Dia) where Dia is the diameter of the threaded portion of the fastener 42 being used. During use of the program of the present invention, a user inputs the locations of lines P1 and P2 based on the configuration/dimensions of the chord profile 25. Once the positions of the lines P1 and P2 for a particular chord profile 25 are determined, a user can simply input the same line positions P1 and P2 each time the same chord profile 25 is present. Line P1 may be positioned three times the diameter of the threaded portion of fasteners 42 from the side wall 26, and line P2 may be positioned the minimum allowable distance, as determined by the applicable code, from the edges 54 and 55 formed by flanges 52 and 53, respectively. Alternately, the lines P1 and P2 may be positioned further away from edges 54 and 55 provided the heads of the fasteners do not contact raised ridges 50 and 51.

Pursuant to the applicable standards in the illustrated example, at the cut ends of the components (chords and webs), the threaded fasteners 42 are positioned no closer than three tunes the diameter of the threaded portions of fasteners 42 to the cut edge. Although fastener circles 60 may be placed inside lines P1 and P2, the lines P1 and P2 are preferably positioned such that the fastener circles 60 do not extend over the raised areas of ridges 51 and 52. In addition to the priority lines P1 and P2, priority lines PW1 and PW2 are generated for side wall 27 using substantially the same criteria as just described for lines P1 and P2. It will be understood that the additional priority lines on side wall 27 are utilized in substantially the same manner as P1 and P2 to determine the locations of fastener circles 60/threaded fasteners 42.

A variety of web members having different shapes and sizes may be connected to a chord having the chord profile 25. In general, web members may have a tubular construction with a rectangular cross-sectional shape. For example, with reference to FIG. 4A, a tubular web member 61 has a side wall 62 having a dimension "A", a tubular web member 63 (FIG. 413) has a side wall 64 having a dimension of "B", and a tubular web member 65 (FIG. 4C) has a side wall 66 having a dimension "C". In the illustrated examples, the dimension A is 1.5 inches, the dimension B is 2.5 inches, and the dimension C is 3.5 inches. In FIG. 4A, the fastener circles 60 are shown positioned at the closest possible positions relative to the side walls 67 and 68 of tubular web member 61. In FIG. 4B, the fastener circles 60 are shown positioned as closely as possible to the side walls 69 and 70 of tubular web member 63, and in FIG. 4C, the fastener circles 60 are positioned as closely as possible to the side walls 71 and 72 of tubular web member 65. The lines PW1 and PW2 pass through the centers of the fastener circles 60, and designate the boundaries of the permissible areas for positioning threaded fasteners 42.

The program of the present invention generates lines PW1 and PW2 and positions them at the minimum fastener spacing as illustrated by fastener circles 60. With reference to FIG. 4A, the program also compares the length of the lines representing side walls 67 and 68 to the length of the line representing the end edge 57 of tubular web member 61, and assumes the shortest of the lines 57, 67, and 68, is the end of chord 61. The program then generates an end line PW3 extending orthogonally between lines PW1 and PW2. End line PW3 is spaced inwardly from end 57 a distance equal to three times the diameter of the threaded portion of fasteners 42 or other distance, depending upon the engineering criteria specified for the truss 1. Similarly, the program also generates end lines PW3 for the tubular web member 63 (FIG. 4B) and web member 65 (FIG. 4C). End lines PW3 represent the closest allowable spacing of fasteners 42 to the ends 57, 58, and 59, of tubular web members 61, 63, and 65, respectively.

As discussed in more detail below, at the joints between a chord having a chord profile 25 (FIG. 4) and one of the tubular web members 61 (FIG. 4A), 63 (FIG. 4B), and 65 (FIG. 4C), the lines P1 and P2 may be "superimposed" on the lines PW1, PW2, and PW3, to form an area representing all allowable fastener locations for a joint. According to one aspect of the present invention, the method/program includes positioning the fastener circles 60 (and threaded fasteners 42) as closely as possible to the side walls 67-72 to maximize the spacing between the fastener circles 60 and threaded fasteners 42 to thereby maximize the strength of the joint. Alternately, the program may be configured to determine the center of the area representing the allowable fastener locations, and the threaded fasteners 42 may be positioned to radiate outwardly from the center.

With reference to FIG. 5, a second chord profile 30 includes a pair of raised ridges 75 and 76 on side wall 32, and a pair of raised ridges 77 and 78 on side wall 33. Priority lines P1 and P2 are selected by a user of the program in substantially the same manner as described above in connection with the chord profile 25 of FIG. 4. Priority lines P2 and P3 are positioned between folded-over flanges 79 and 80 and raised ridges 76 and 78, respectively. In a preferred embodiment, the priority lines P2 and P3 are chosen such that fastener circles 60 can be positioned at 45° relative to each other. For example, if a tubular web member 81 (FIG. 5A) is positioned at a 90° angle relative to a chord having chord profile 30, the program may be configured to position a pair of fastener circles 60 on priority lines P1 and P4. The program may be configured to position a pair of fastener circles 60 on priority line P2, and to position a single fastener circle 60 on the priority line P3. Alternately, a pair of fastener circles 60 can be positioned by the program on priority line P3, and a single fastener circle 60 can be positioned on the priority line P2.

If a tubular web member 82 (FIG. 5B) is positioned at an angle θ1 relative to a chord having profile 30, two fastener circles 60 may be positioned by the program on priority lines P2 and P3, and three fastener circles 60 can be positioned on the priority line P1. In addition to the priority lines P1-P4 extending along the chord having the chord profile 30, web profile line PW1 and PW2 extend along the tubular web members 81 and 82. The web priority lines PW1 and PW2 may be generated by the program, and represent the closest possible positioning of the fastener circles 60 relative to the side walls 83 and 84 of tubular web member 81 and the side walls 85 and 86 of tubular web member 82, based upon the fastener positioning standards required by the building code and/or engineering criteria utilized for the roof truss 1 being made. An end line PW3 extends between lines PW1 and PW2. End line PW3 is spaced a distance 3.0*Dia from the cut end 87 of tubular web member 82, and represents the closest possible spacing of the threaded fasteners 42 to the end 87 of tubular web member 82 according to the applicable code. The program determines the proper orientation of line PW3 in substantially the same manner as discussed above for end line PW3 of FIGS. 4A, 4B, and 4C.

Figure 6:
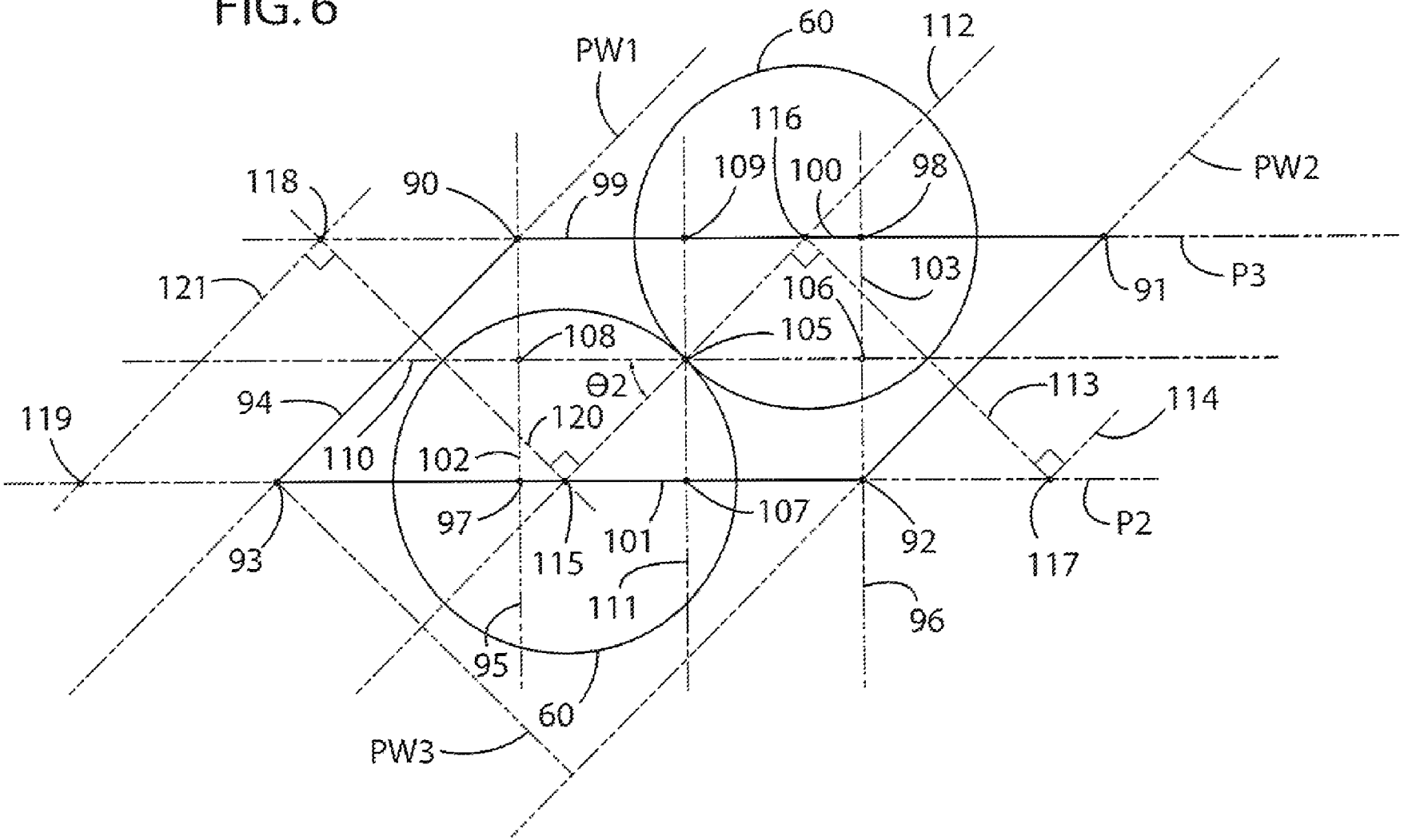
FIG. 6 is an enlarged view of a portion of FIG. 5 showing the position of the fasteners.

In the areas between chord priority lines P2 and P3, the program positions the threaded fasteners 42 in a pattern that allows the maximum possible (or close to the maximum possible) number of fasteners in the joint. One preferred pattern is a zig-zag pattern. With further reference to FIG. 6, the chord priority lines P2 and P3 of chord profile 30 intersect with the web priority lines PW1 and PW2 at the points 90, 91, 92 and 93. The points 90-93 form the corners of a parallelogram 94 formed by the intersection of the chord priority lines P1 and P2 with the web priority lines PW1 and PW2. The area within parallelogram 94 therefore represents all allowable locations for the centers of fastener circles 60/threaded fasteners 42 for a particular joint or portion of a joint.

The optimum positioning for the fastener circles 60/threaded fasteners 42 may be determined according to the program/method of the present invention as follows. First, a line 95 extending through point 90, perpendicular to line P2, is formed, and a line 96 extending through point 92, perpendicular to line P3, is formed. Line 95 intersects the chord priority line P2 at a point 97, and the line 96 intersects the priority line P3 at a point 98. The lines 95 and 96 and portions of the chord priority lines P2 and P3 extending between the lines 95 and 96 form a rectangle 99 having sides 100-103. In the illustrated example, sides 100 and 101 are horizontal, and sides 102 and 103 are vertical. The center point 105 of rectangle 99 is located by dividing the sides 100-103 of rectangle 99 in half to locate the center points 106-109 of the sides 100-103, and forming a (horizontal) center line 110 and a (vertical) center line 111. The intersection of the center lines 110 and 111 is the center point 105 of rectangle 99. Point 105 is also the center of parallelogram 94. Alternately, the center 105 of parallelogram 94 may be located by generating a first line (not shown) that intersects points 91 and 93, and a second line (also not shown) that intersects points 90 and 92. These two lines intersect at center point 105.

A diagonal line 112 is then formed. Diagonal line 112 intersects center point 105, and extends at an angle θ2 of 45° relative to center line 110. A point 115 is formed at the intersection of diagonal line 112 and priority line P2. The point 115 is the center of the first fastener circle 60. A second point 116 is formed at the intersection of diagonal line 112 and priority line P3, and a second fastener circle 60 is centered at point 116. A second diagonal line 113 is then formed. The diagonal line 113 passes through the point 116, and extends at a 90° angle relative to the diagonal line 112. The intersection of the second diagonal line 113 and the priority line P2 forms a point 117 that forms the center of a third fastener circle 60. A third diagonal line 114 is then formed. The diagonal line 114 extends through the point 117, and the diagonal line 114 is orthogonal to the diagonal line 113. In this way, the center points 115, 116, 117, etc. can be generated. Because the diagonal lines 112, 113, 114, etc. extend at a 45° angle relative to the chord priority lines P2 and P3, the fastener circles 60 are thereby positioned in a zigzag pattern that fills in the allowable area for the fasteners defined by the parallelogram 94.

In general, the process of generating diagonal lines and center points for the fastener circles continues until one of the center points falls outside of the parallelogram 94. Also, alter the diagonal lines 112, 113, and 114 are formed to one side of the center point 115, a line 120 may be formed. The line 120 extends at a right angle relative to the diagonal line 112. The intersection of diagonal line 120 and priority line P3 forms a center point 118. If the center point 118 is within the parallelogram 94, a fastener circle 60 is positioned at center point 118, and another diagonal line 121 extending through center point 118 is formed. Diagonal line 121 is orthogonal relative to diagonal line 120. Diagonal line 120 intersects the priority line P2 at a point 119. If the center point 119 is inside of the parallelogram 94, a fastener circle 60 is positioned on the center point 119. Alternately, if the center point 119 falls outside of the parallelogram 94, no additional diagonal lines are drawn, and a fastener circle 60 is not positioned at the point 119.

In the example illustrated in FIG. 6, the first line 112 was drawn such that the first intersection or center point 115 was positioned towards the point 93 forming an acute corner of the parallelogram 94. In general, the orientation of the line 112 is chosen so that it is approximately parallel to the web priority lines PW1 and PW2. This is done by checking the distance from the center point 107 relative to the points 92 and 93 forming the corners 92 and 93 of parallelogram 94. The angle θ2 of the diagonal line 112 relative to a line 110 is always 45°, and the orientation of line 112 is chosen such that point 115 will be closest to the acute-angled corner formed at point 93 of parallelogram 94. In general, the zigzag positioning of the clearance circles 60 continues according to the pattern described above until one of the intersection points forming a potential center of a clearance circle 60 falls outside of the parallelogram 94. The zigzag pattern is continued in both directions until one of the potential center points formed by the intersection of a diagonal line and a chord priority line P2 and P3 falls outside of the parallelogram 94.

Figure 7:
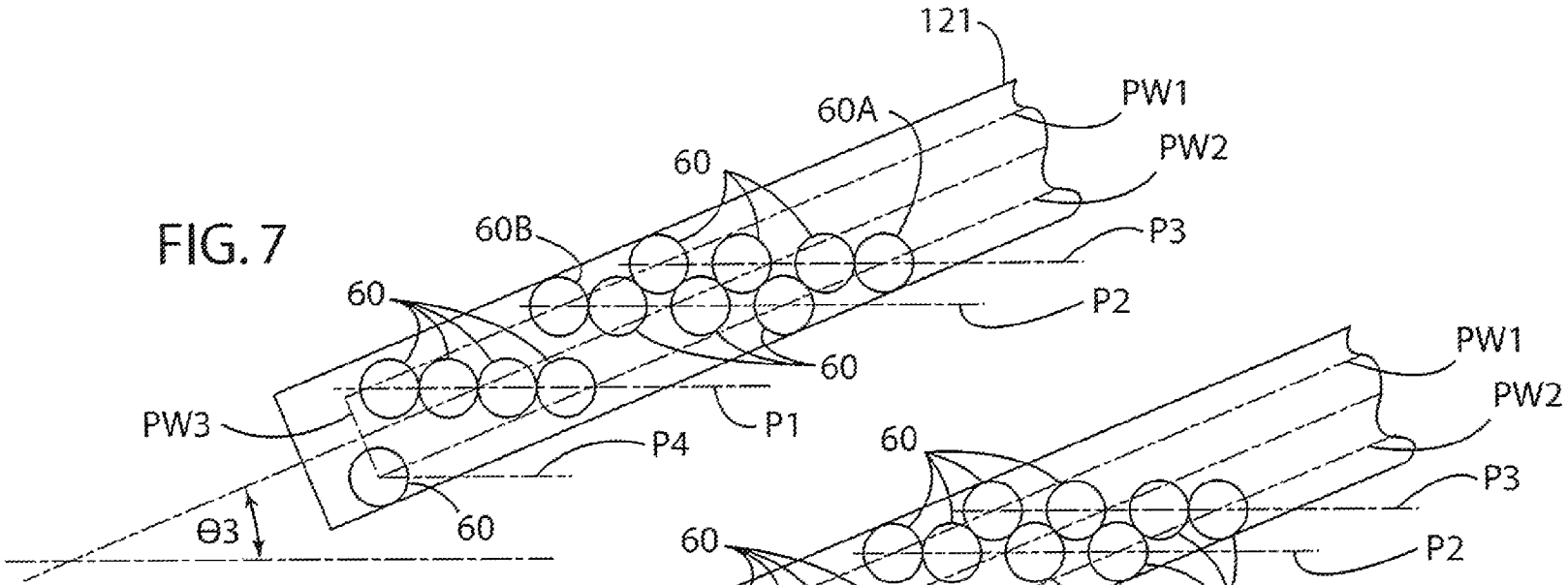
FIG. 7 is a schematic view showing the position of the fasteners when the chord of FIG. 5 is secured to a web at a first angle.
Figure 8:
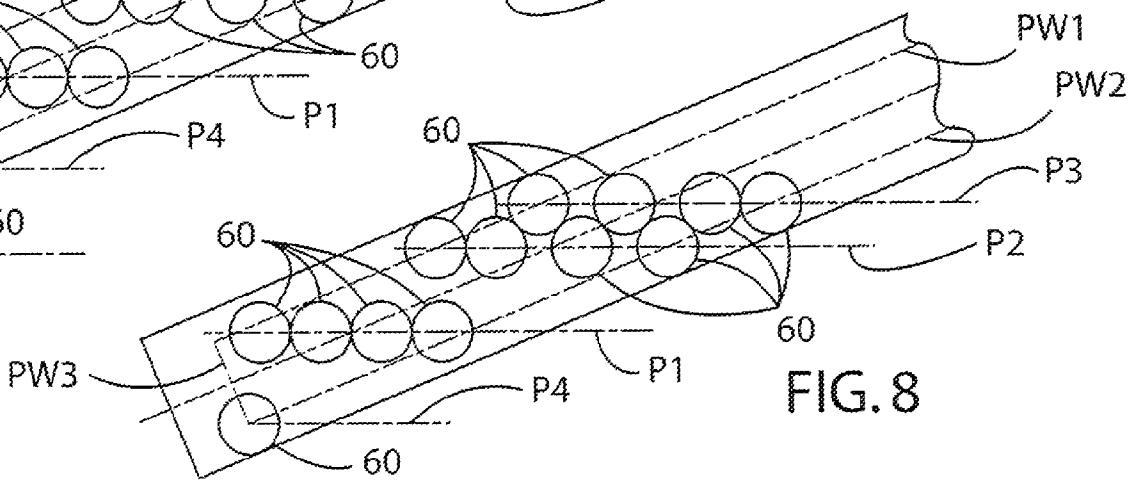
FIG. 8 is a schematic view showing the position of the fasteners when the chord of FIG. 5 is secured to a web at a second angle.
Figure 9:
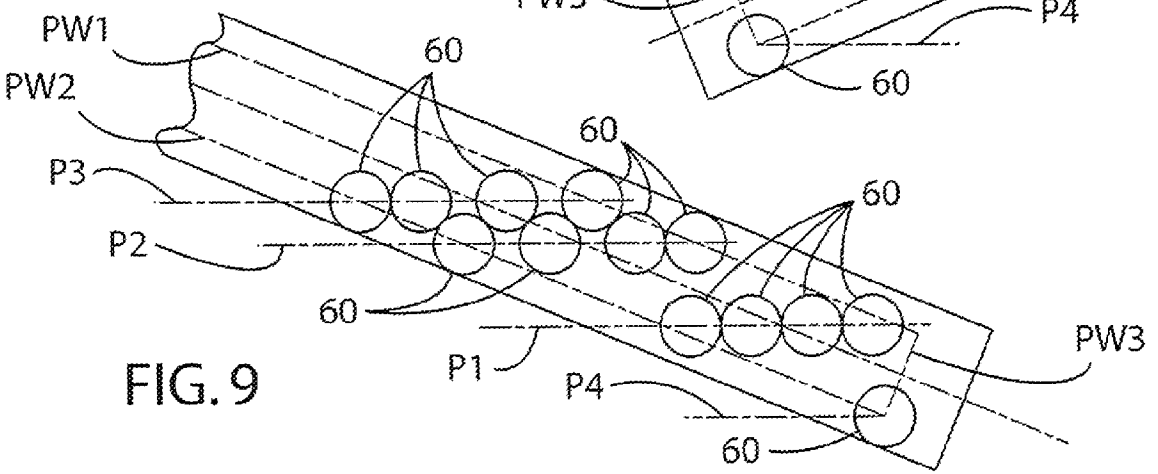
FIG. 9 is a schematic view showing the position of the fasteners when the chord of FIG. 5 is secured to a web at a third angle.

The method for determining the position of the clearance circles 60 (and center of threaded fasteners 42) can be generalized to handle virtually any joint geometry possible. A Variety of different joint geometries are illustrated in FIGS. 7-12. With reference to FIG. 7, a web 121 intersects a chord at angle θ3. The angle θ3 is quite small, such that in addition to the zigzag clearance circles 60, additional clearance circles 60A and 60B may be positioned on the priority lines P2 and P3. In order to generalize the method described above to accommodate a situation shown in FIG. 7, the zigzag placement of clearance circles 60 is continued until one of the potential center points of the clearance circles 60 falls outside of the parallelogram 94. The program then checks to determine if there is sufficient space on the priority lines P2 and P3 to place another clearance circle 60A or 60B on the priority line P2 or P3 without the additional clearance circle 60A or 60B falling outside of the parallelogram 94 formed by the intersection between the priority lines P2, P3, and the priority lines PW1 and PW2. The additional fastener circles 60 are positioned with the edges of the fastener circles 60 being tangent to the adjacent fastener circles 60. Once again, it will be understood that the program/method does not require that fastener circles 60 be generated; the centers of the fastener circles 60 are the fastener locations being determined, and the fastener circles 60 are shown to illustrate the positions of the fastener locations.

Figure 10:
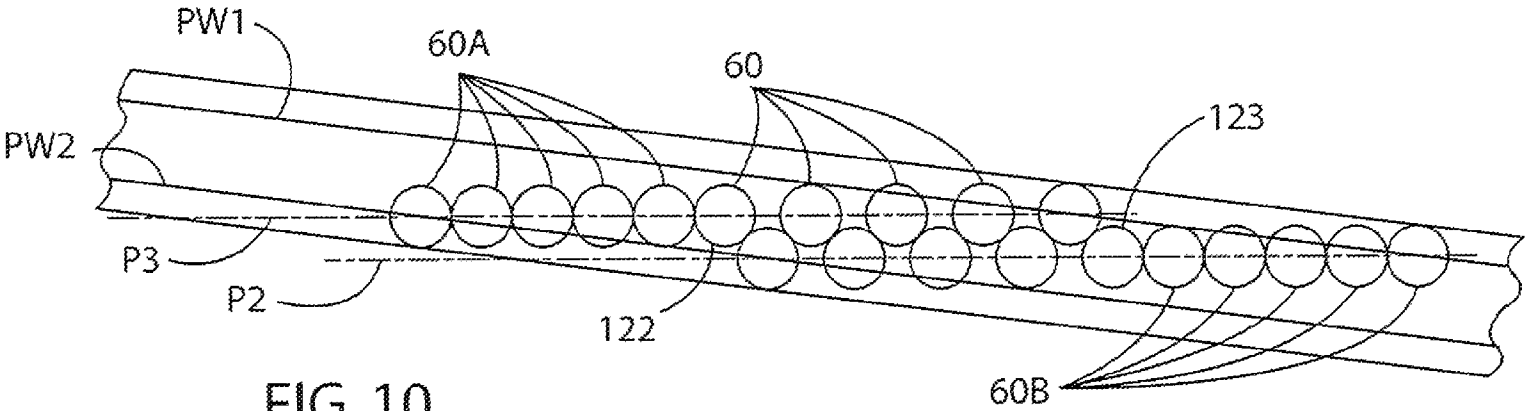
FIG. 10 is a schematic view showing the position of the fasteners when the chord of FIG. 5 is secured to a web at a fourth angle.

The program/method of the present invention preferably places the maximum possible number of fastener circles 60 on the priority lines P1 and P4. FIGS. 8-12 further illustrate the placement of fastener circles 60 for different joint geometries. With reference to FIG. 10, when the angle between the priority lines P2 and P3, and the priority lines PW1 and PW2 becomes quite small, a relatively large number of additional fastener circles 60A and 60B will be positioned on the lines P2 and P3. The program/method of the present invention will position as many of the "extra" fastener circles 60A and 60B as possible. In general, the program will continue to calculate potential center points for the fastener circles 60A and/or 60B until one of the potential center points falls outside of the parallelogram 94. The potential center points for the fastener circles 60A and 60B can be determined by positioning a series of points on the priority lines P2 and P3, with adjacent points spaced apart a distance equal to the diameter of the fastener circles 60. For example, a plurality of the potential center points are positioned on the priority line P2 directly adjacent the outermost fastener circle 123 in the zigzag pattern. Each of the potential center points is preferably positioned a distance equal to one fastener diameter circle 60 away from the adjacent center point. The center points for the fastener circles 60B are therefore determined, and clearance circles 60B are continued to be placed until one of the center points falls outside of the parallelogram 94. Alternately, the circles (fastener locations) could be spaced apart a distance that is somewhat greater than the minimum allowable spacing.

Figure 11:
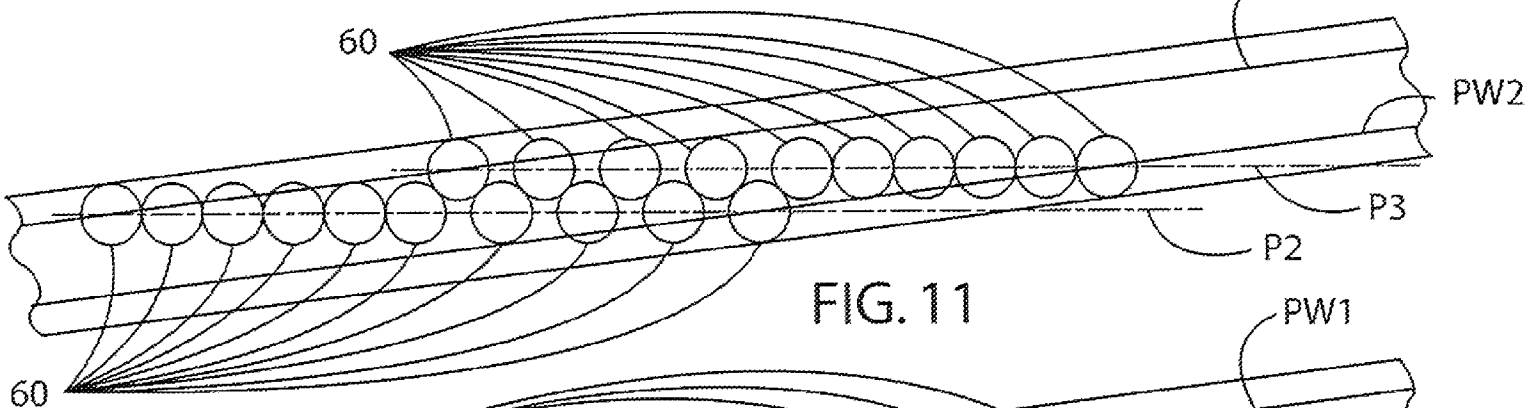
FIG. 11 is a schematic view showing the position of the fasteners when the chord of FIG. 5 is secured to a web at a fifth angle.
Figure 12:
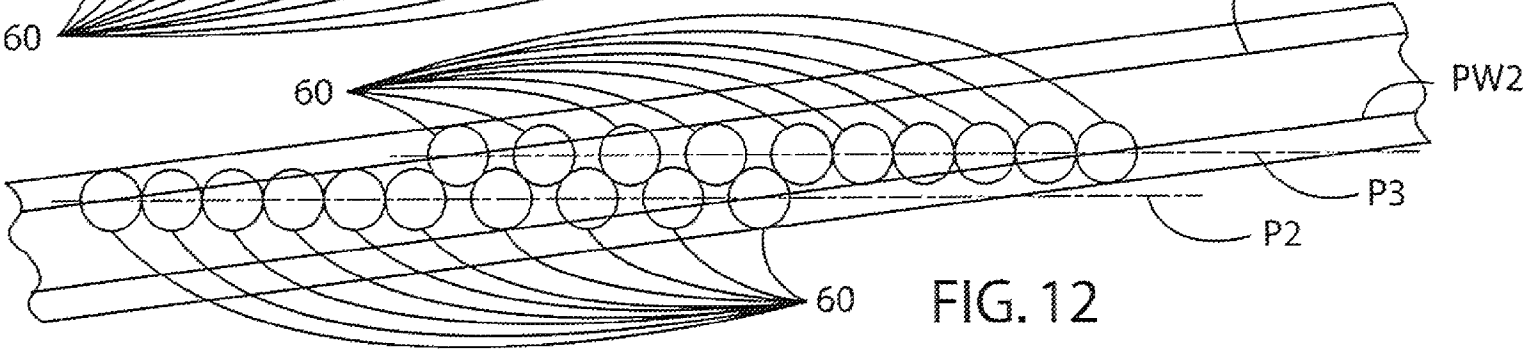
FIG. 12 is a schematic view showing the position of the fasteners when the chord of FIG. 5 is secured to a web at a sixth angle.

As shown in FIGS. 11 and 12, the method just described can be utilized to determine the fastener locations for joints having even smaller intersection angles between the priority lines P2 and P3, and the priority lines PW1 and PW2. The method described above is implemented by a computer program that automatically determines the positions of the clearance circles 60 and therefore the centers of the threaded fasteners 42.

In addition to the zigzag pattern utilized to fill in a trapezoid formed by the intersection of priority lines P1, P2 with priority lines PW1, PW2, the program/method of the present invention also determines the position for fasteners on single priority lines, such as the priority lines P1 and P4 as shown in FIG. 5. Priority lines P1 and P4 extend along portions of side walls 32 and 33 that are not large enough to permit placement of adjacent priority lines such as the lines P2 and P3. In the case of single priority lines, the program places as many fastener circles 60 as possible on the chord priority lines P1 and P4 between the web priority lines PW1 and PW2. In general, a first clearance circle 60 may be placed at an intersection of priority lines P1 and PW1, and additional points can be placed on line P1 a distance equal to the diameter of clearance circle 60 until a potential center point falls outside the line PW2. If the program determines that a chord priority line (e.g., P4) does not intersect a web priority line PW1 or PW2, no fastener circles 60 will be placed on priority line P1. In a preferred embodiment, a single priority line (e.g., P1 and P4; FIG. 5) is utilized for areas of the chord side wall that are not large enough to permit a pair of priority lines that are spaced apart far enough to permit placement of fasteners in a 45 degree zig-zag pattern, as described above. However, it will be apparent that other zig-zag patterns could be utilized. For example, if a pair of closely-spaced priority lines were utilized instead of the single priority line P4 (FIG. 5), a zig-zag pattern defining angles of greater than 90 degrees between the lines extending through the centerlines of adjacent fastener locations could be utilized.

Also, the method/program may be utilized to fill in larger areas with a zigzag pattern. Referring back to FIGS. 5 and 6, chord priority lines P2 and P3 may be spaced further apart if, for example, profile 30 does not include a raised ridge 78. If P2 is sufficiently far apart from P3, three (or more) rows of fastener circles 60 can be positioned between lines P2 and P3. The program can be configured to check the vertical distance between P2 and P3, and determine the number of rows of fastener circles that will fit between the lines P2 and P3. In general, each row of the zigzag requires a vertical spacing of $R*\sin \theta 2$, where $\theta 2=45°$.

If, for example, three rows will fit, the center point 105 is located in substantially the same manner as described above. However, a middle row of fastener circles 60 is placed on a line passing through point 105 parallel to P2 and P3, and line 112 is extended until it intersects P2 and P3. The method/program positions fastener circles 60 on line 112 at a distance equal to the diameter of fastener circle 60. The method/program fills in the parallelogram in a zigzag pattern by generating second and third diagonal lines on opposite sides of line 112, and parallel to line 112. The second and third lines are spaced from line 112 by a distance equal to the diameter of fastener circle 60. Additional fastener circles 60 are positioned on the second and third diagonal lines at the intersections between additional lines that are perpendicular to line 112 and the second and third diagonal lines. These perpendicular lines extend through the centers of fastener circles 60 on line 112, such that additional rows of fastener circles 60 are generated on each side of the row of fastener circles 60 on line 112, with the circles oriented to form a zigzag. Additional diagonal lines are formed, as are perpendicular lines, until the centers fall outside the parallelogram created by the intersections of the chord priority lines and the web priority lines. The method/program then fills in additional fastener circles 60A, 60B (FIG. 10) on the chord priority lines PW1 and PW2, with the fastener circles 60 being spaced apart a distance equal to the diameter of the fastener circles 60. It will be understood that the program does not necessarily need to generate actual fastener circles 60 at each fastener location; the fastener circles 60 are shown to illustrate the/why the centers of the fasteners are positioned as they are by the method/program.

Figure 17:
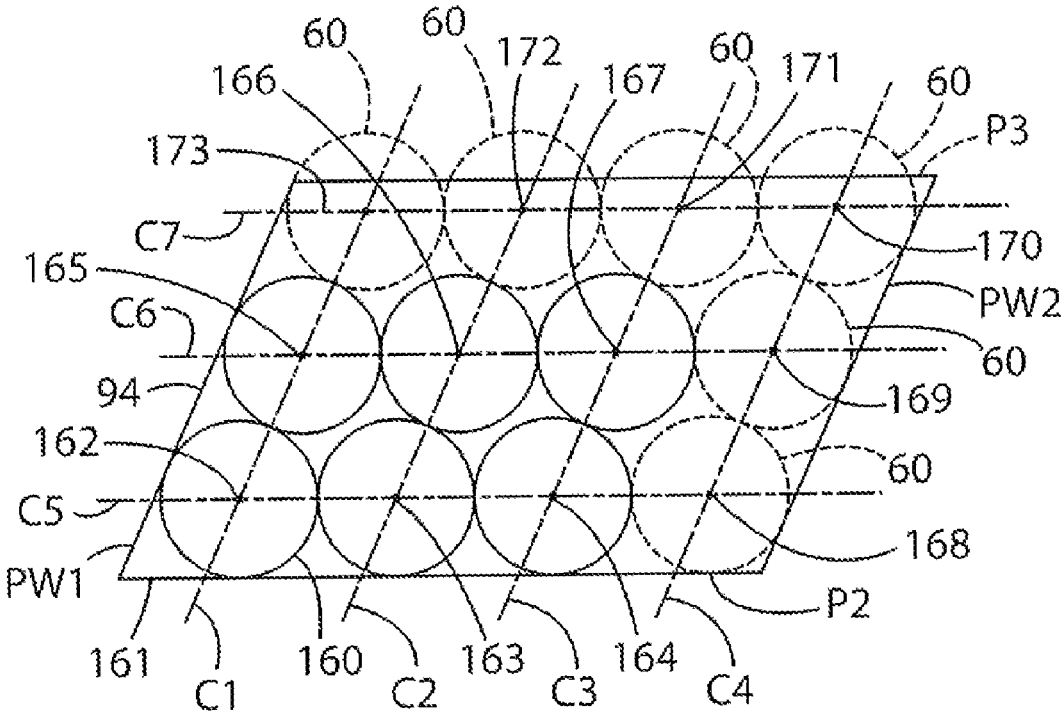
FIG. 17 shows an alternate fastener-locating scheme.

As discussed above in connection with FIG. 6, the intersection of priority lines PW1 and PW2 with the priority lines P2 and P3 forms a parallelogram 94. In addition to the method described above in connection with FIG. 6, alternate methods for positioning the fastener locations represented by fastener circles 60 within parallelogram 94 may also be utilized, and examples of such methods are shown in FIGS. 17-21. With reference to FIG. 17, a first fastener circle 160 may be positioned at a corner 161 of parallelogram 194, with the first fastener circle 160 being tangent to the lines PW1 and P2. A plurality of lines C1-C4 that are parallel to line PW1 can then be generated, wherein the lines C1-C4 are spaced apart a distance equal to the diameter of fastener circle 160. Similarly, a plurality of lines C5, C6, and C7, can also be generated, wherein each of the lines C5-C7 are spaced apart a distance equal to the diameter of fastener circle 160. The lines C1-C4 are parallel to the lines PW1 and PW2, and the lines C5-C7 are parallel to the lines P2 and P3. Additional fastener locations 162-167 are then generated at the intersections of the lines C1-C4 and C5-C7. The fastener locations 162-167 are initially positioned at each of the intersections of the lines C1-C4, and C5-C7. The fastener locations are then checked to determine if a given potential fastener location is spaced less than the minimum allowable distance from one of the lines PW1, PW2, P2, and P3, such that the minimum allowable spacing criteria for the fasteners is met. The fastener circles 60 that are spaced too closely to one of the lines PW1, PW2, P2 or P3, are shown in dashed lines in FIG. 17, and the potential fastener locations 168-173 associated with these potential fastener circles 60 are not included in the final list of fastener locations included in the output data (FIG. 14) described in more detail below.

Figure 18:
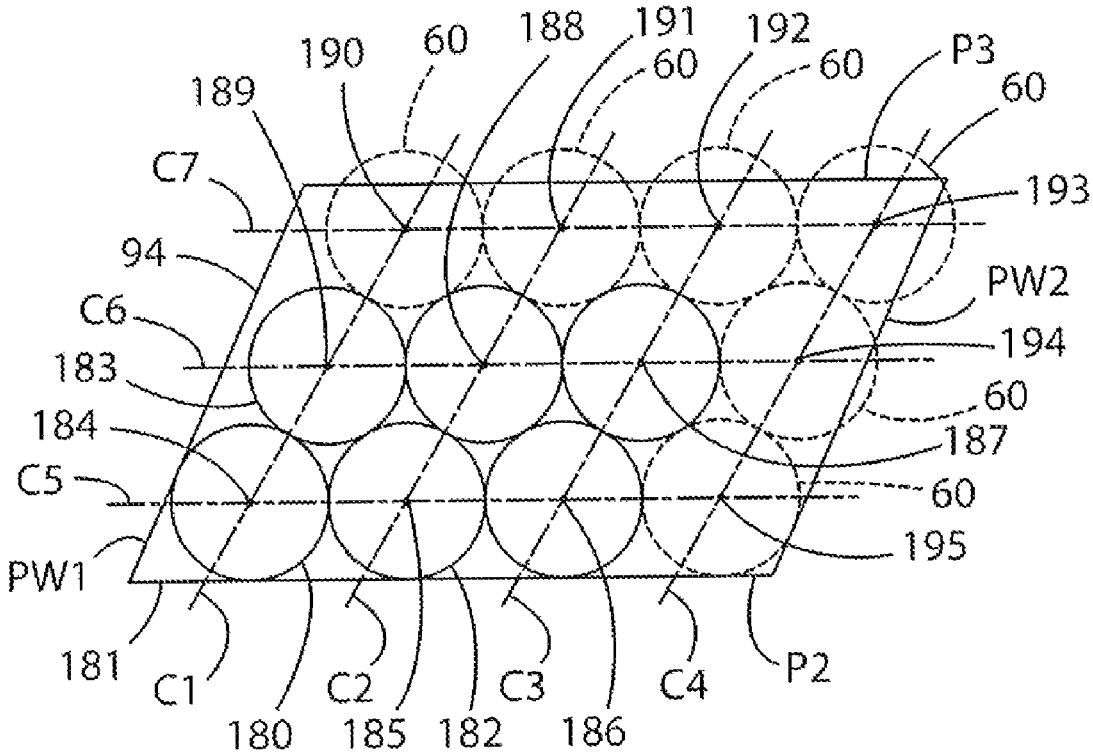
FIG. 18 shows an alternate fastener-locating scheme.

With further reference to FIG. 18, according to another method a first fastener circle 180 is placed at a corner 181 of parallelogram 194, and a plurality of lines C1-C4 and C5-C7 are generated. A second fastener circle 182 is positioned directly adjacent first fastener circle 180 such that second fastener circle 182 is tangent to line P2 and to fastener circle 180. A third fastener circle 183 is then generated, with third fastener circle 183 being tangent to first fastener circle 180 and second fastener circle 182. Lines C1-C4 and C5-C7 extending through the fastener locations 184-189 can be generated, and potential fastener locations 190-195 are generated. The potential fastener locations 190-195 are not included in the output file (FIG. 14) because potential fastener locations 190-195 are positioned too closely to the boundaries of the parallelogram 194.

Figure 19:
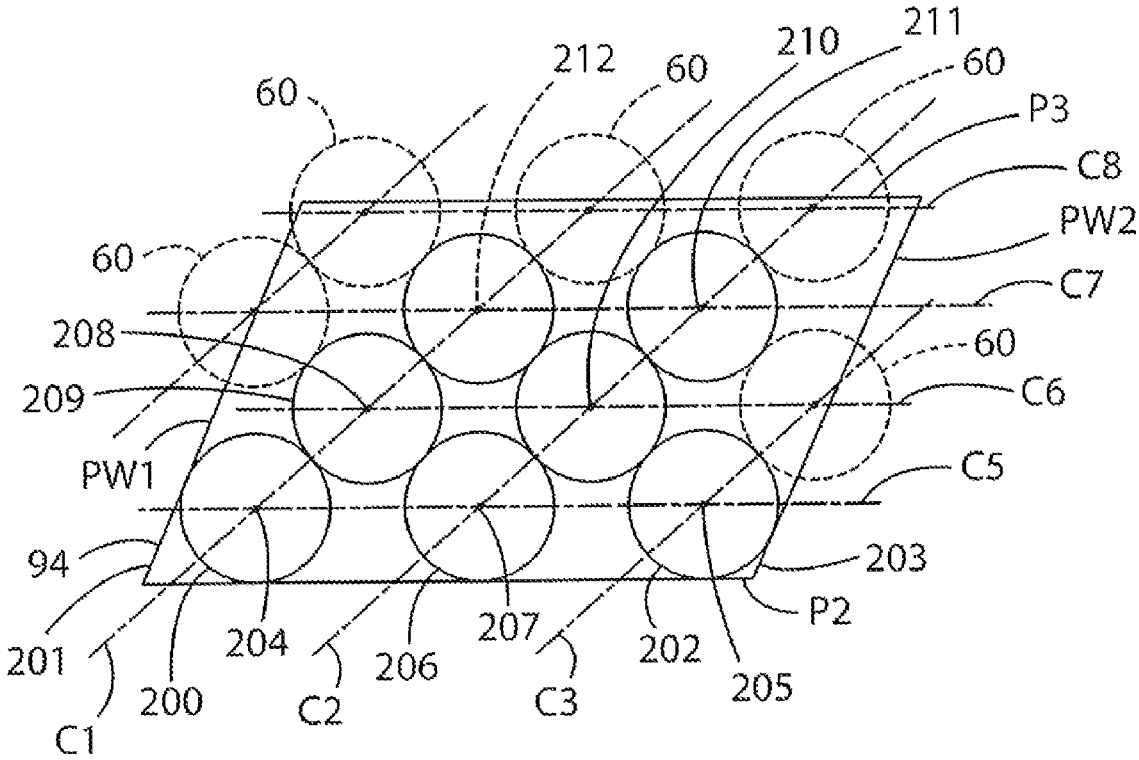
FIG. 19 shows an alternate fastener-locating scheme.

With further reference to FIG. 19, yet another method for determining the fastener locations includes positioning a first fastener circle 200 at a first corner 201 of parallelogram 194 with the first fastener circle 200 being tangent to the line PW1 and P2. A second fastener circle 202 is then positioned at a second corner of parallelogram 94, with the second fastener circle 202 being tangent to the lines P2 and PW2. The distance between first fastener location 204 at the center of first fastener circle 200 and the second fastener location 205 at the center of second fastener circle 202 is then determined, and the maximum possible number of additional fastener circles such as third circle 206 are then positioned between the first fastener circle 200 and second fastener circle 202 along a line C5 extending through the first fastener location 204 and second fastener location 205. The additional fastener circles are spaced at equal intervals along the line C5. In the illustrated example, only one additional circle 206 fits on line C5, such that fastener location 207 is centered between fastener locations 204 and 205. Fastener location 208 is located at a point at the center of a fastener circle 209 that is tangent to fastener circles 200 and 206. A plurality of additional fastener locations 210-212 can then be generated at the intersections of lines C1-C3 and C5-C8. The potential fastener locations that are too close to any of the lines defining parallelogram 94 are not included in the final list, and these potential fastener locations are illustrated by dashed circles 60 in FIG. 19.

Figure 20:
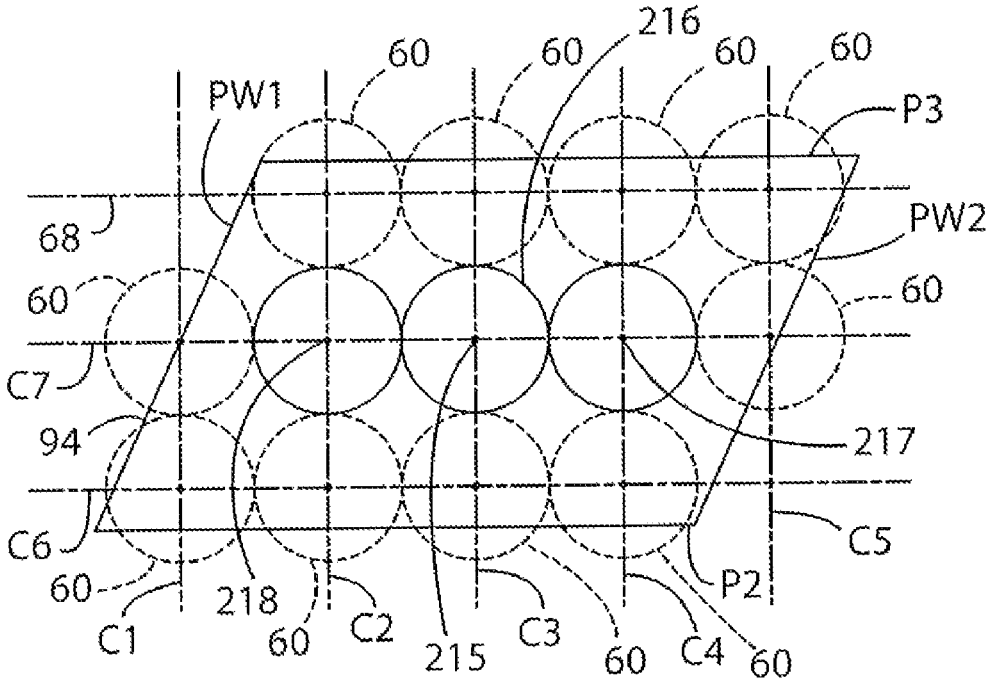
FIG. 20 shows an alternate fastener-locating scheme.

With further reference to FIG. 20, yet another method for determining the fastener locations includes determining a center point 215 of parallelogram 94. A plurality of lines C1-C5 that are perpendicular to lines P2 and P3 are then generated, wherein the lines C1-C5 are spaced apart a distance equal to the diameter of a fastener circle 216 at the center of parallelogram 94. A plurality of lines C6-C8 is also generated, wherein the lines C6-C8 are parallel to the lines P2 and P3. A plurality of fastener locations 217 and 218 and potential fastener locations represented by the fastener circles 60 are also generated.

Figure 21:
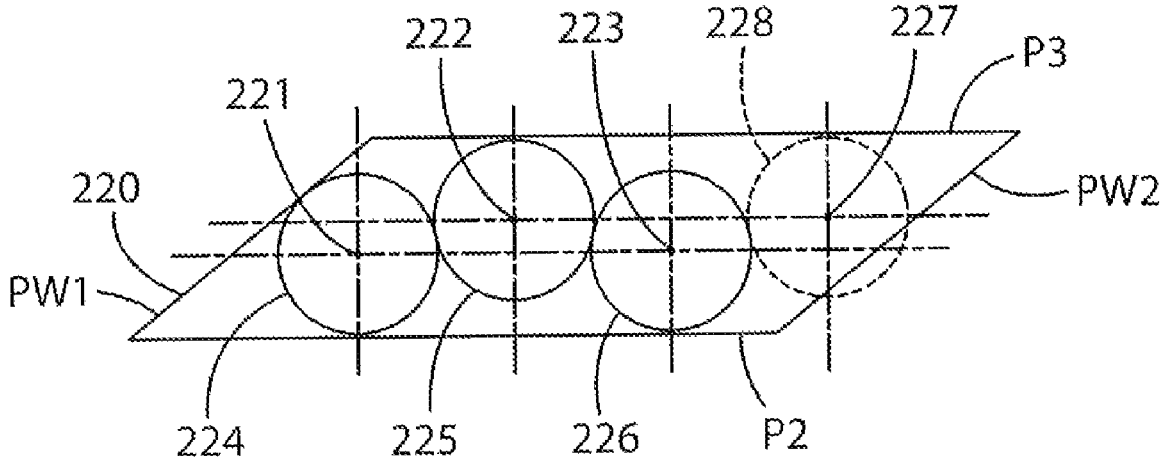
FIG. 21 shows an alternate fastener-locating scheme.

As discussed above, lines P2 and P3 may be quite close to one another to form a parallelogram 220 that is relatively narrow, such that the fastener locations cannot be positioned in a zig-zag pattern as show in FIG. 6. As discussed above, if the parallelogram 94 (FIG. 6) does not permit spacing of the fastener locations in the pattern illustrated in FIG. 6, the fastener locations are generally positioned along a single line, with each of the fastener locations being spaced apart from the adjacent fastener locations by a distance equal to the diameter of the fastener circles 60. However, as shown in FIG. 21, a plurality of fastener locations 221-223 may, alternately, be positioned in a "shallow" zig-zag pattern. In the illustrated example, a first fastener circle 224 is positioned such that it is tangent to the lines PW1 and P2. A second fastener circle 225 is then positioned tangent to the first fastener circle 224, and tangent to line P3. A third fastener circle 226 is then positioned tangent to fastener circle 225 and line P2. A potential fastener location 227 is initially generated, but it is not included in the final list of fastener locations because the potential fastener location 227 is too close to line PW2 as shown by the dashed fastener circle 228. It will be recognized that the first fastener location 221 and circle 224 of FIG. 21 may alternately be positioned at the center of parallelogram 220, and the additional fastener locations may then be placed in a shallow zig-zag pattern moving outwardly from the center.

In addition to determining the positions of the threaded fasteners 42, the method/program also determines a sequence for the threaded fasteners 42 at each joint. The sequence determines the order in which the fasteners of a specific joint are installed by the truss assembly machine of the above-identified co-pending U.S. patent application Ser. No. 11/961,522. Although a variety of ways to sequence the fasteners could be used, one way to sequence the fasteners includes forming a vertical line through the center point 105 (FIG. 6) of a joint. The method/program than assigns a sequence number, starting with "1", by finding the fastener (circle 60) closest to the vertical line and the lowest numerical value for the variable "X" (FIG. 6), and the highest numerical value for the variable Y. The program then assigns "Z" the fastener of those remaining for the joint that is closest to the vertical line and having the lowest X value and the greatest Y value.

As discussed above, a minimum number of fasteners for each joint is determined by the engineering software. When assigning the sequence to the fasteners, the method/program also designates each fastener a "primary" fastener until the minimum number of required fasteners for a particular joint is reached, after which the fasteners are designated "alternate." The alternate fasteners are not used (i.e., installed by the truss assembly machine) unless at least one of the primary fasteners fails to be installed properly, as measured by the automatic screw-driving heads of the machine. The truss assembly machine is programmed to always install all of the primary fasteners. If all of the primary fasteners are properly installed, the alternate fastener locations are not used. However, if at least one primary fastener is not properly installed, the machine will install the alternate fasteners in the assigned sequence until the minimum required number of fasteners are properly installed at the joint.

The method/program also divides the trusses into zones and assigns the joints to the zones. As described in detail in co-pending U.S. patent application Ser. No. 11/961,522, the powered screw-driving heads of the truss assembly machine are mounted on first and second gantries. The trusses are moved through the machine in discrete steps or distances utilizing clamps on the gantries and stationary clamps. The gantries drive all of the screws in a given section of the truss before the truss is moved so that the threaded fasteners in the next section or area can be installed by the gantries.

Figure 13:
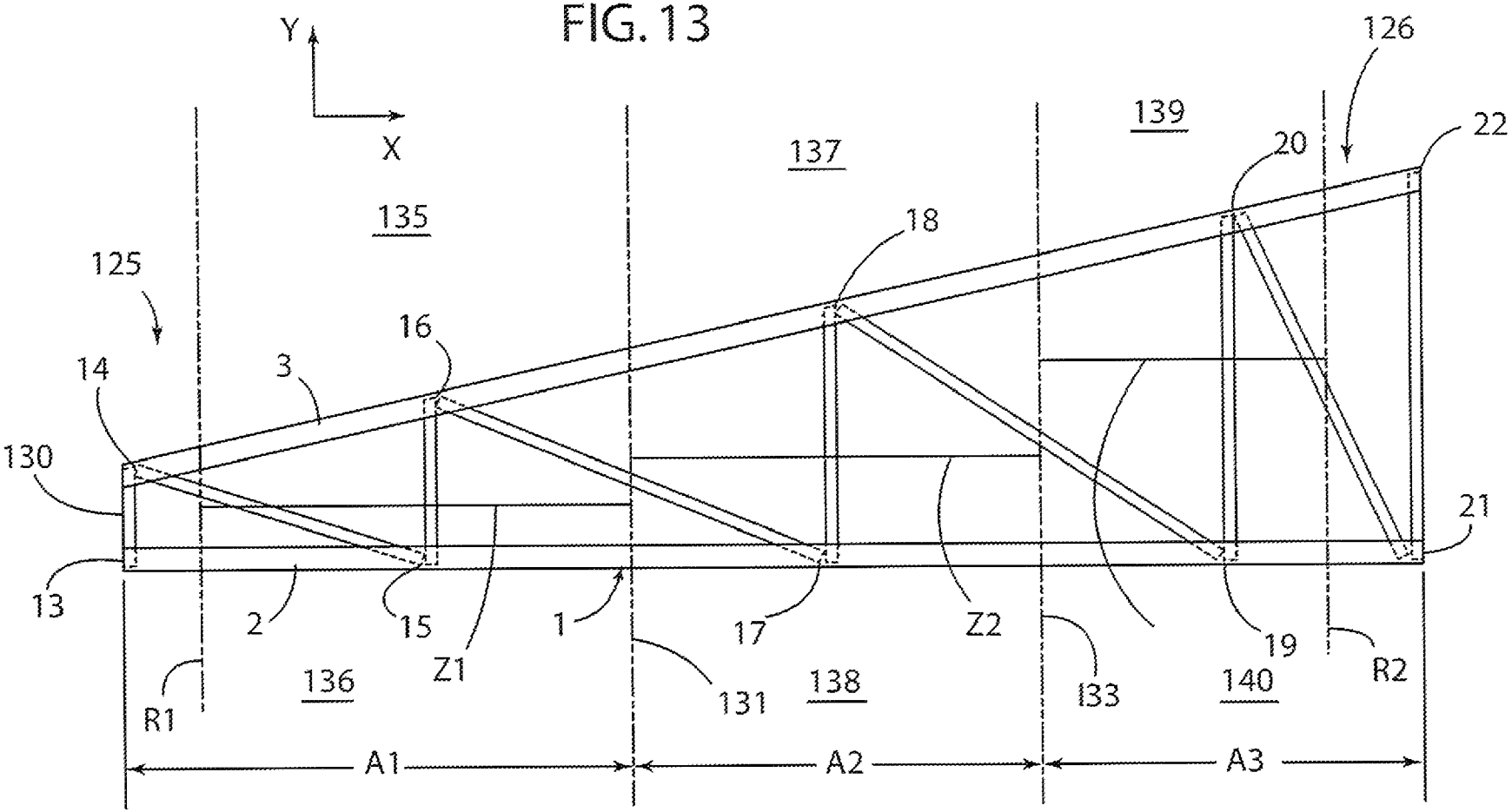
FIG. 13 is a partially schematic view of a truss that has been divided into areas for assembly.

With reference to FIG. 13, the method/program divides truss 1 into sections or areas to facilitate efficient operation of the truss assembly machine. Reserve lines R1 and R2 are positioned just inside the ends 125, 126, respectively of truss 1. All of the fasteners at the joints 13, 14 at end 125, and the joints 21, 22 at end 126, must be driven by a single gantry when the end 125 or 126 is first entering the truss assembly machine (end 125) or exiting the truss assembly machine (end 126). The reserve lines R1 and R2 represent the maximum distance from the edge of the truss 2 where the threaded fasteners 42 can be driven when the ends 125, 126 of the truss are in a cantilevered position as the truss 2 is entering or exiting a work envelope of the machine. Thus, reserve lines R1 and R2 are positioned just far enough inwardly from the ends of truss 2 to permit the gantries of the truss assembly machine to access the joints 13, 14 and 21, 22 at the ends of truss 2.

After the reserve fasteners at joints 13 and 14 are driven, the truss assembly machine advances (moves) or indexes the truss 1 so the first and second gantries can drive fasteners in joints 15 and 16 in index area A1 formed between edge 130 of truss 1 and a first index line 131. The distance between line 131 and edge 130 is no more than the maximum possible area (work envelope) by the first and second gantries without indexing the truss 1. The method/program generates additional index lines 133, etc. to form index areas A2, A3, etc., until the entire truss 1 is divided into index areas. Also, zone lines Z1, Z2, Z3, etc. are generated. The zone lines divide the index areas into zones 135-140.

The method/program thereby generates an output file 150 (FIG. 14) listing the fasteners according to the assigned sequence, wherein the first fastener and its associated data is the top row of the data file, the second fastener is the second row, etc. A first column 151 includes a letter "F" if the row of data is for a primary fastener, and an "S" if the row of data is for an alternate fastener. Second column 152 lists the X coordinates for the fastener, and third column 153 lists the Y value for the fastener.

A fourth column 154 lists the "torque value" for the fastener. The torque value is a number assigned to the fastener based upon the thicknesses of the chord, web, and plate (if present) the fastener is to be driven through. The controller of the truss assembly machine is programmed to retrieve expected torque data from a look up table (not shown) based on the torque value for a particular joint. This expected torque data is compared to measured torque values as the fastener is being driven to determine if the fastener satisfies predetermined criteria (i.e. it was properly driven through all of the plates). If a particular fastener does not satisfy the predetermined criteria, an alternate fastener "S" is driven into the joint.

Figure 16:
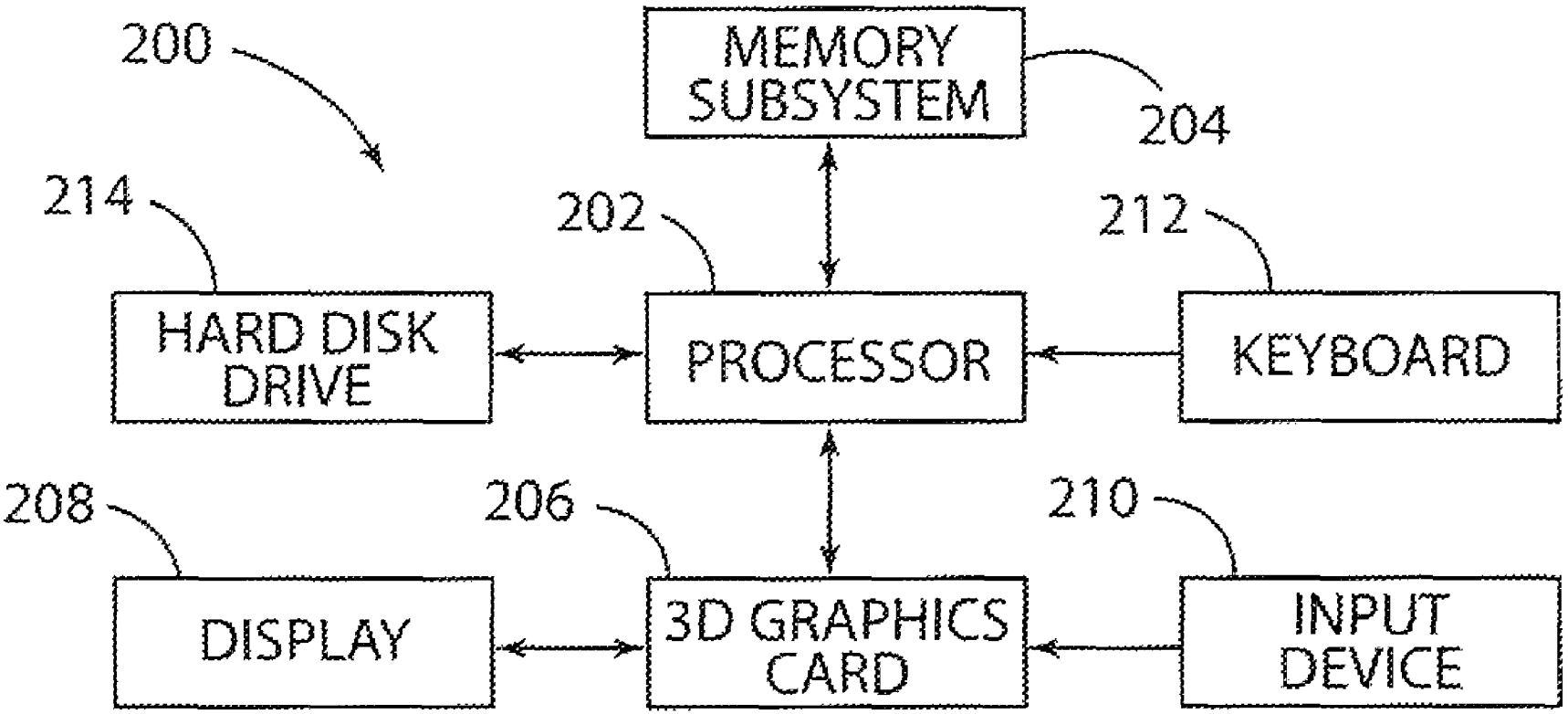
FIG. 16 is a block diagram of a typical computer system that can be utilized for executing the program/method.

A fifth column 155 lists the plate number, a sixth column 156 lists the joint number, and the seventh column 157 lists the zone number corresponding to the zones 135-140, etc. in FIG. 16. If two adjacent joints both have the same plate, they will be assigned the same plate number. The controller of the truss assembly machine is programmed such that all joints having the same plate number are grouped together, and only one of the gantries will be assigned to all joints having the same plate number. This avoids the problem of physical interference between the two gantries due to the close proximity of the joints that would otherwise occur if both gantries attempted to drive fasteners in adjacent joints having the same plate number. It will be understood that two adjacent joints may be assigned the same "plate number", even if the joints to not actually have a plate that is common to both joints; the "plate number" represents a group of joints that are in close proximity such that only a single gantry can drive fasteners in the group of joints.

Referring again to FIG. 14, in addition to the fasteners "F" and "S", output file 150 also includes reserve rows or lines "R", and index rows or lines "I". These rows/lines correspond to the reserve lines R1 and R2 (FIG. 13) and the index lines 131, 133, etc. (FIG. 13).

The truss assembly machine is programmed to utilize the output file to assemble the truss in an efficient manner. Each gantry of the machine has a "home" position within an area A1, A2, A3, etc. The first gantry's home is the highest X position in the area A1, A2, etc. being worked on as defined by a reserve line or an index line, and the second gantry's home is the lowest X position in the area being worked on.

The machine first selects the zone within the area being worked on having the greatest number of fasteners. The first gantry then starts driving fasteners at the joint closest to its home position and having the lowest Y value. The fasteners are driven in the sequence that was previously determined. The second gantry also starts driving fasteners at the joint closest to its home position having the lowest Y value, in the previously-set sequence. In general, the first gantry starts at the fastener location having the lowest X value, and the second gantry starts at the fastener location having the greatest X value. The fasteners are listed in output file 150 in order as the value of the X dimension increases. Thus, the first gantry starts with the first fastener in column 152 and installs the fasteners in sequence (going "down" column 152), and the second gantry starts at the last fastener in column 152, and installs fasteners in sequence going "up" column 152. This sequence is, however, subject to additional conditions.

Because the powered screw-driving heads on the gantries would physically interfere with one another if they were to attempt to simultaneously drive fasteners at the same joint, the machine assigns a joint to a gantry at the time the next joint to be worked on is determined. Once a joint is assigned to one gantry, the other gantry will not select a joint that is already assigned, but will instead skip to the next available joint, wherein the "next" joint is selected to be the closest joint to the home position for the gantry, and having the lowest Y value. If no joints in the zone are available because all fasteners have been driven and the last joint in the zone has been assigned, the gantry will then go to the next zone within the area being worked oil. The gantry will then proceed within the zone according to the rules set forth above. If all zones within an area have already been completed (i.e., all fasteners driven), the gantry will wait until the other gantry has completed the last joint. The machine will then advance the truss to the next area, and the gantries will again proceed according to the rules set forth above.

Because the gantries start on opposite sides of the work areas at their respective home positions, interference between the gantries is minimized. Also, the rules by which the gantries select joints minimizes the movement of the gantries and also minimizes time spent by one gantry waiting for the other to complete a joint and move out of the way. Because the total number of fasteners that need to be driven at each joint will vary depending upon how many alternate fasteners are required, it is not possible to predict in advance exactly how much time will be required to drive all of the fasteners at a given joint. The method just described by which the gantries select joints permits the truss assembly machine to adapt to different conditions without unduly hurting efficiency. It will be understood that the order of joint/zone selection may vary depending on what sequence provides optimum efficiency for a particular truss configuration.

The software/method of the present invention also assigns a "torque number" to each fastener in a joint. The "torque number", in turn, is utilized to retrieve a data set for each fastener 42. As discussed above, each threaded fastener 42 is driven through the side walls of the chord and web members, and may also be driven through a plate if a particular joint includes a plate. The thicknesses for the side walls for each possible chord member and each possible web member are known, as are the possible plate thicknesses. These known thicknesses can be utilized to determine all possible combinations of side wall thicknesses and plate thicknesses for all possible joint configurations. As discussed above, the torque characteristics for the threaded fasteners 42 are known for each wall thickness. This information can be used to calculate the torque versus time characteristics for the threaded fasteners for all of the possible combinations of side walls thicknesses and plate thicknesses. These torque characteristics comprise a set of data including the expected torque verses time. When the program is determining the fastener locations, each fastener location is checked to determine the number of layers that a fastener at that location will be expected to go through, and a torque value is assigned based upon this information. In this way, each fastener location has torque data associated with it that can be used to determine if the threaded fastener has actually gone through the expected number of layers. The automatic screw-driving guns (not shown) utilized to drive the threaded fasteners 42 include sensors that can measure the torque as the fasteners are driven. The actual torque values recorded as the particular fastener is driven can be compared to the expected torque data to determine if the threaded fastener has actually been driven through the expected number of layers. If the measured torque data falls outside of an expected range, the program determines that the fastener did not meet the requirements.

Figure 15:
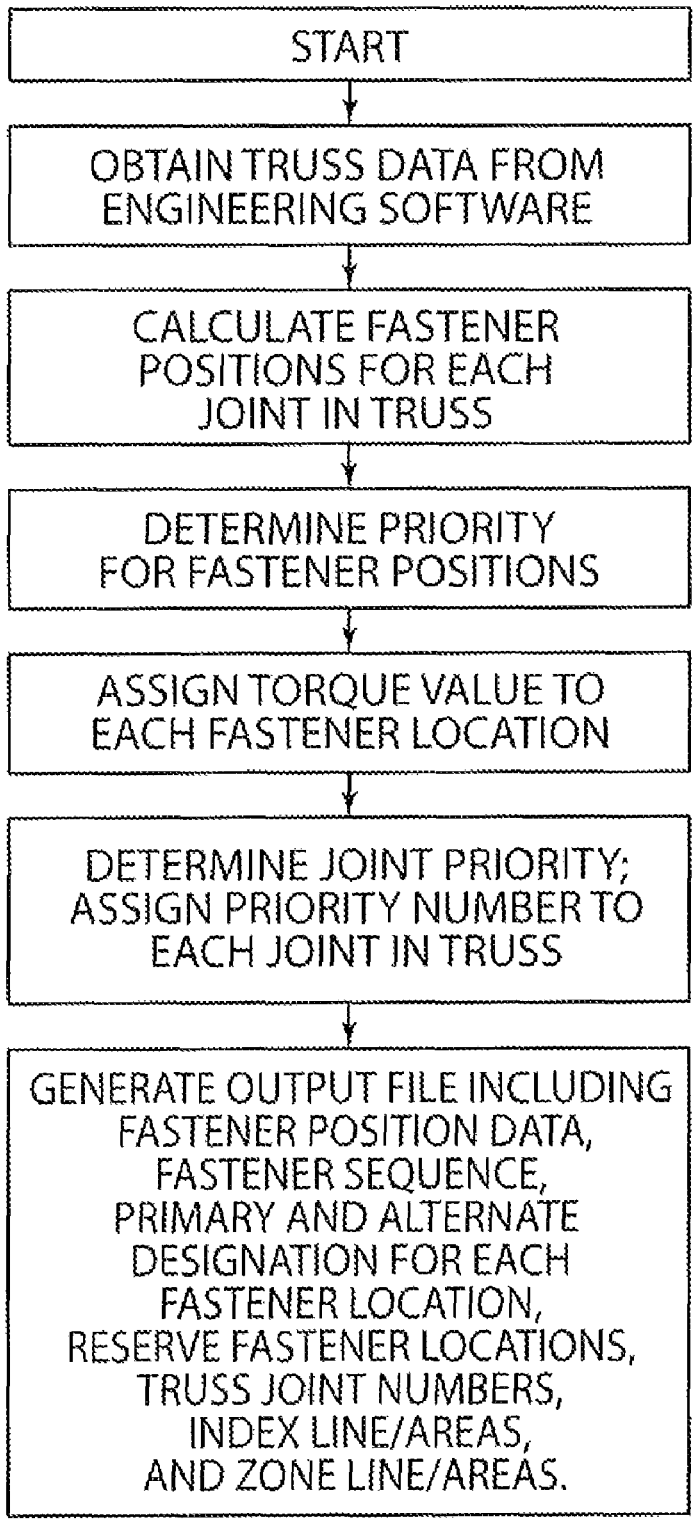
FIG. 15 is a flowchart showing a method of determining fastener locations according to one aspect of the present invention.

With further reference to FIG. 15, a method or program according to the present invention first obtains truss data from the engineering software utilized to design the truss 1 (FIG. 1). In general, the data will include the positions of the chords and webs, as well as the cross-sectional shape information and the like for each truss and web. The engineering data will also include information concerning the number and location of any plates utilized to reinforce the joints between the chords and webs. The program then calculates the fastener positions for each joint in the truss utilizing the zigzag pattern noted above. The priority lines for each chord and web cross-sectional shape are predetermined, such that the program can generate the priority lines based upon the data obtained from the engineering software relating to the cross-sectional shape of the truss members and web members. As described above, the program will generate a zigzag pattern if a pair of parallel priority lines has been assigned to a particular chord profile. The program will then fill in additional fastener locations (circles) along the priority lines, with each adjacent fastener location being positioned one fastener circle diameter away from the next, until a potential fastener center is outside of the priority lines.

As the program is determining the fastener locations, the program also determines if each fastener center is going through a plate in addition to the side walls of the web and truss members. Based upon this information, a torque value is assigned to each fastener location. As the information for each joint is generated, a joint number is assigned to the group of fastener locations for each joint, and a joint priority is assigned to each joint. The screw-driving machine will then utilize the joint priority data and the fastener location and priority data to automatically drive the screws at each of the joints at the locations determined by the method described in detail above.

FIG. 16 is a block diagram of a typical computer system that can be utilized for executing a program that executes the method described in detail above. System 200 includes a processor 202 that is coupled to a keyboard 212, a memory sub-system 204, a fixed or removable hard disk drive 214 (e.g., a CD-ROM) and a 3D graphics card 206. Memory subsystem 204 includes an application appropriate amount of volatile and non-volatile memory. Hard disk drive 214 is used for storing an operating system and various applications and data. 3D graphics card 206 is coupled to an input device 210 (e.g., a mouse) and a display 208. 3D graphics card 206 receives input from a user through input device 210 and provides output to a user through display 208. One of skill in the art will appreciate that other computer systems may be utilized to run software incorporating the method of the present invention.

The method/software of the present invention permits a very tightly-spaced fastener location patterns at each joint. The method can be utilized to automatically generate the fastener locations for all of the possible joint geometries and chord and web member configurations possible for a wide range of roof trusses. The software can be utilized by the screw-driving machine to automatically drive screws at the fastener locations, and the torque of the screws can be measured as they are driven to determine if the threaded fasteners have been properly installed through the expected number of layers of material.

In the preferred embodiment, the steps of the method described above are used by the software program and the steps are carried out by a processor or other computer hardware that executes the software. However, some of the steps may be carried out by a user, and the resulting data may be input to the software program, with the remaining steps of the method being executed by the software. For example, the position of the priority lines P1 and P2 (FIG. 4) may be determined by a user and input into the program in use, or the software may be configured to determine the position of the priority lines based upon other data such as the chord profile.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The invention claimed is:

1. A system for generating data for assembly of roof trusses, comprising:

a processor;

a memory subsystem coupled to the processor, the memory subsystem storing information;

an input device coupled to the processor, the input device receiving input from a user; and fastener-positioning code that utilizes truss data including the positions of truss members to be assembled in a predefined configuration to form a truss having a plurality of joints interconnecting the truss members, wherein the fastener-positioning code is embodied in the memory subsystem for causing the processor to perform the steps of:

determining an allowable area at each joint within which fasteners can be located according to predetermined criteria;

generating a plurality of discrete fastener locations within the area, wherein each fastener location is spaced-apart from adjacent fastener locations by at least a predetermined minimum fastener-to-fastener distance, wherein:

the truss data includes information concerning the length and the cross-sectional configuration of at least first and second truss members that intersect to define a first truss joint, and wherein the processor further performs the steps of:

generating at least a first pair of spaced-apart priority lines for a first truss member extending along the length of the first truss member, wherein the first pair of priority lines are positioned according to across-sectional configuration of the first truss member such that the first pair of priority lines define a first area therebetween;

generating at least a second pair of spaced-apart priority lines for a second truss member extending along the length of the second truss member, wherein the second pair of priority lines are positioned according to a cross-sectional configuration of the second truss member such that the second pair of priority lines define a second area therebetween; and wherein:

the step of determining an allowable area at each joint within which fasteners can be located according to predetermined criteria includes defining an allowable first area at the first truss joint that is bounded, at least in part, by the first and second pairs of priority lines.

2. The system of claim 1, wherein:

the first truss member defines a first axis extending along the length of the first truss member, and the first pair of priority lines are parallel to the first axis;

the second truss member defines a second axis extending along the length of the second truss member, and the second pair of priority lines are parallel to the second axis; and the allowable first area is in the shape of a parallelogram.

3. The system of claim 2, further including the steps of:

determining a center point of the first area;

determining a first fastener location that is spaced apart from the center point at least one-half the predetermined minimum fastener-to-fastener distance;

determining a second fastener location that is spaced apart from the first fastener location by at least the predetermined minimum fastener-to-fastener distance.

4. The system of claim 3, wherein:

the center point of the first area and the first and second fastener locations define a straight line.

5. The system of claim 4, wherein:

the straight line is parallel to the first pair of priority lines.

6. The system of claim 5, further including the steps of:

determining a potential third fastener location that is spaced-apart from the second fastener location a distance at least as great as the predetermined minimum fastener-to-fastener distance; and wherein:

the potential third fastener location is positioned such that a line through the second and third fastener locations is perpendicular to the straight line.

7. The system of claim 6, further including the step of:

determining if the potential third fastener location is within the allowable first area.

8. A system for generating data for assembly of roof trusses of the type having fasteners at joints interconnecting linear structural members forming chords and webs, the system comprising:

a processor;

a memory subsystem coupled to the processor, the memory subsystem storing information;

an input device coupled to the processor, the input device receiving input from a user;

fastener-positioning code embodied in the processor for causing the processor to perform the steps of:

determining an allowable area at each joint within which fasteners can be located according to predetermined criteria;

generating a plurality of discrete fastener locations within the area, wherein each fastener location is spaced-apart from adjacent fastener locations by at least a predetermined minimum fastener-to-fastener distance, wherein:

the processor determines an allowable area by acquiring truss information including joint information for joints of a truss to be made, the truss having at least one chord connected to at least one web at a truss joint, wherein the chord and the web each include sidewalls, and wherein portions of the side walls of the chord overlap portions of the side walls of the web at the truss joint, the truss joint information including a minimum required number of fasteners for the truss joint, and an angle between the one chord and the one web;

the processor defines first and second fastener priority lines extending parallel to one another along portions of the chord in the vicinity of the truss joint, wherein the first and second fastener priority lines of the chord are located on portions of the side wall of the chord that meet predetermined engineering criteria with respect to placement of fasteners;

the processor further defining first and second priority lines extending parallel to one another along portions of the web in the vicinity of the truss joint, wherein the first and second fastener priority lines of the web are located on portions of the side wall of the web that meet predetermined engineering criteria with respect to placement of fasteners;

wherein the first and second fastener priority lines of the chord intersect the first and second fastener priority lines of the web to define at least a portion of a perimeter of the allowable fastener area within which fasteners can be located to satisfy the predetermined engineering criteria.

9. The system of claim 8, wherein:

the allowable fastener area determined by the processor has the shape of a parallelogram.

10. The system of claim 9, wherein:

the processor determines the center point of the parallelogram.

11. The system of claim 10, wherein:

the processor determines a first fastener location at a point that is spaced from the center point of the parallelogram a distance at least as great as one-half the predetermined minimum allowable fastener-to-fastener distance along a center line extending through the center point of the parallelogram and forming an angle of approximately 45 degrees relative to the first and second fastener priority lines of the chord.

12. The system of claim 11, wherein:

the parallelogram has a first pair of opposite corners defining acute angles; and the center line is generally parallel to the first and second fastener priority lines of the web.

13. The system of claim 12, wherein:

the processor determines a second fastener location on the center line that is spaced apart from the first fastener location a distance at least as great as the minimum allowable fastener-to-fastener distance.

14. The system of claim 13, wherein:

the center line comprises a first center line; and wherein:

the processor generates a third fastener location that is spaced apart from the second fastener location a distance at least as great as the minimum allowable fastener-to-fastener distance, and wherein the third fastener location is on a second center line that is approximately perpendicular to the first center line and extends through the second fastener location.

15. The system of claim 8, wherein:

the processor groups the fastener locations according to the positions of the fastener locations on a truss, and wherein each group corresponds to an index area defined by at least one index line extending across the truss in a direction transverse to a direction the truss moves through a truss assembly machine.

16. The system of claim 15, wherein:

adjacent index lines are spaced apart a distance that is no greater than a width of a work envelope of a truss assembly machine.

17. The system of claim 8, wherein:

the processor utilizes a data file including:

coordinates for each fastener location;

index lines that extend transverse to a direction of movement of a truss through a truss assembly machine;

a fastener parameter associated with each fastener location;

a joint identifier for each fastener location of each truss joint;

an identifier for all fastener locations of adjacent truss joints; and a zone identifier for each fastener location positioned within a zone, wherein the zone members designate zone areas within the index areas.

18. The system of claim 17, wherein:

the data file further includes a reserve identifier associated with selected ones of the fastener locations that are adjacent opposite ends of the truss.

19. The system of claim 18, wherein:

the truss information includes a minimum number of fasteners for each truss joint;

the data file further includes identifiers for each fastener location that identifies each fastener location as either a primary fastener location or an alternate fastener location, and wherein the number of primary fastener identifiers is equal to the minimum number of fasteners for each joint location.

20. A system for generating data for assembly of roof trusses of the type having fasteners at joints interconnecting linear structural members forming chords and webs, the system comprising:

a processor;

a memory subsystem coupled to the processor, the memory subsystem storing information;

an input device coupled to the processor, the input device receiving input from a user;

fastener-positioning code embodied in the processor for causing the processor to perform the steps of:

determining an allowable area at each joint within which fasteners can be located according to predetermined criteria;

generating a plurality of discrete fastener locations within the area, wherein each fastener location is spaced-apart from adjacent fastener locations by at least a predetermined minimum fastener-to-fastener distance, wherein:

the processor determines an allowable area by acquiring truss information including joint information for joints of a truss to be made, and wherein the truss information includes data relating to the thickness of the material at the truss joint into which fasteners are to be driven, the truss having at least one chord connected to at least one web at a truss joint, wherein the chord and the web each include sidewalls, and wherein portions of the side walls of the chord overlap portions of the side walls of the web at the truss joint, the truss joint information including a minimum required number of fasteners for the truss joint, and an angle between the one chord and the one web;

the processor defines first and second fastener priority lines extending parallel to one another along portions of the chord in the vicinity of the truss joint, wherein the first and second fastener priority lines of the chord are located on portions of the side wall of the chord that meet predetermined engineering criteria with respect to placement of fasteners;

the processor further defining first and second priority lines extending parallel to one another along portions of the web in the vicinity of the truss joint, wherein the first and second fastener priority lines of the web are located on portions of the side wall of the web that meet predetermined engineering criteria with respect to placement of fasteners;

wherein the first and second fastener priority lines of the chord intersect the first and second fastener priority lines of the web to define at least a portion of a perimeter of the allowable fastener area within which fasteners can be located to satisfy the predetermined engineering criteria, wherein:

the processor utilizes fastener installation criteria for each joint that is determined, at least in part, based on the thickness of the material;

the processor associates the fastener installation criteria with each fastener location.

21. The system of claim 20, wherein:

the truss information includes the number of layers of material and the thicknesses of each layer of material at each truss joint.

22. The system of claim 20, including:

a fastener-installing device that measures a fastener parameter during installation of the fasteners; wherein:

the fastener-installing device is configured to compare the fastener parameter to the fastener installation criteria for each fastener location to determine if the fastener parameter satisfies the fastener installation criteria.

23. The system of claim 22, wherein:

the fastener parameter comprises a torque applied to threaded fasteners by the fastener-installing device during installation of the threaded fasteners.

24. The system of claim 22, wherein:

the processor assigns a joint identifier to all fastener locations at each truss joint.

* * * * *